US009557681B2

(12) United States Patent
Nishiwaki et al.

(10) Patent No.: US 9,557,681 B2
(45) Date of Patent: Jan. 31, 2017

(54) DEVELOPING DEVICE, PROCESS CARTRIDGE AND IMAGE FORMING APPARATUS

(71) Applicants: Kenjiro Nishiwaki, Nagoya (JP); Takanori Uno, Nisshin (JP); Takuya Amaike, Nagoya (JP); Masateru Kawamura, Toyoake (JP); Kazuna Taguchi, Nagoya (JP); Motoaki Mushika, Hashima (JP); Yasuo Fukamachi, Nagoya (JP); Shunji Yoshimoto, Nagoya (JP); Masahiro Ishii, Nagoya (JP)

(72) Inventors: Kenjiro Nishiwaki, Nagoya (JP); Takanori Uno, Nisshin (JP); Takuya Amaike, Nagoya (JP); Masateru Kawamura, Toyoake (JP); Kazuna Taguchi, Nagoya (JP); Motoaki Mushika, Hashima (JP); Yasuo Fukamachi, Nagoya (JP); Shunji Yoshimoto, Nagoya (JP); Masahiro Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/139,932

(22) Filed: Dec. 24, 2013

(65) Prior Publication Data

US 2014/0178093 A1 Jun. 26, 2014

(30) Foreign Application Priority Data

Dec. 26, 2012 (JP) ..... 2012-282068
Dec. 26, 2012 (JP) ..... 2012-282072
(Continued)

(51) Int. Cl.
*G03G 15/08* (2006.01)

(52) U.S. Cl.
CPC ..... *G03G 15/0817* (2013.01)

(58) Field of Classification Search
CPC ..... G03G 15/0817; G03G 15/0898
(Continued)

(56) References Cited

U.S. PATENT DOCUMENTS 6,212,343 B1 4/2001 Hosokawa et al.
6,834,170 B2 12/2004 Choi et al.
(Continued)

FOREIGN PATENT DOCUMENTS

JP 2000-235304 A 8/2000
JP 2000-242077 A 9/2000
(Continued)

OTHER PUBLICATIONS

JP 2010156919 English translation, Oyoshi et al., Jul. 2010.*
JP 2003205525 English translation, Noguchi, Jul. 22, 2003.*

*Primary Examiner* — David Gray
*Assistant Examiner* — Thomas Giampaolo, II
(74) *Attorney, Agent, or Firm* — Banner & Witcoff, Ltd.

(57) ABSTRACT

A developing device includes a casing configured to accommodate developer, a developing roller, a seal member, at least portion of which is disposed between the developing roller and the casing, and which includes a fabric member including a plurality of first fibers extending in a first direction, and a heat radiation member configured to contact end surfaces of the first fibers of the seal member and radiate heat of the seal member.

12 Claims, 27 Drawing Sheets

(30) Foreign Application Priority Data

Dec. 26, 2012 (JP) ..... 2012-282504
Dec. 26, 2012 (JP) ..... 2012-282513

(58) Field of Classification Search
USPC ..... 399/103
See application file for complete search history.

(56) References Cited

U.S. PATENT DOCUMENTS

| | | | | |
|---|---|---|---|---|
| 8,041,250 | B2 | 10/2011 | Matsushita | |
| 2003/0231904 | A1 | 12/2003 | Choi et al. | |
| 2007/0223958 | A1* | 9/2007 | Mori et al. | 399/103 |
| 2009/0226207 | A1 | 9/2009 | Matsushita | |
| 2012/0057897 | A1* | 3/2012 | Itabashi | 399/103 |

FOREIGN PATENT DOCUMENTS

| | | | | |
|---|---|---|---|---|
| JP | 2002-251068 | A | | 9/2002 |
| JP | 2003205525 | A | * | 7/2003 |
| JP | 2003-345127 | A | | 12/2003 |
| JP | 2008-026642 | A | | 2/2008 |
| JP | 2008-216492 | A | | 9/2008 |
| JP | 2009-063635 | A | | 3/2009 |
| JP | 2010-156919 | A | | 7/2010 |
| JP | 2010156919 | A | * | 7/2010 |
| JP | 2011-048402 | A | | 3/2011 |

* cited by examiner

*FIG. 26*

| APPLIED MATERIAL | MANUFACTURER | BRAND | THERMAL CONDUCTIVITY [W/mK] | CATEGORY |
|---|---|---|---|---|
| THERMALLY-CONDUCTIVE ADHESIVE 1 | SUNHAYATO CORP. | MODEL SCH-20 | 0.8 | HEAT RADIATION COMPOUND |
| THERMALLY-CONDUCTIVE ADHESIVE 2 | ITW CHEMTRONICS | CW2400 | 1.5 | CONDUCTIVE ADHESIVE |
| THERMALLY-CONDUCTIVE ADHESIVE 3 | THREEBOND CO., LTD. | 1225B | 1.6 | HIGH THERMALLY-CONDUCTIVE ADHESIVE |
| THERMALLY-CONDUCTIVE ADHESIVE 4 | THREEBOND CO., LTD. | 2955 | 3.0 | HEAT RADIATION RESIN |

DEVELOPING DEVICE, PROCESS CARTRIDGE AND IMAGE FORMING APPARATUS

CROSS-REFERENCE TO RELATED APPLICATION

This application claims priority from Japanese Patent Application Nos. 2012-282068, 2012-282072, 2012-282504 and 2012-282513, all filed on Dec. 26, 2012, the entire subject matters of which are incorporated herein by reference.

TECHNICAL FIELD

Aspects of the present invention relate to a developing device, a process cartridge and an image forming apparatus, which include a seal member for suppressing leakage of developer from a gap between a developing roller and a casing.

BACKGROUND

There has been know a developing device which includes a casing configured to accommodate toner, a developing roller disposed to face an opening formed in the casing, and a seal member disposed between end portions of the developing roller and the casing (for example, JP-A-2009-63635).

Incidentally, in the above-described developing device, the rotating developing roller comes into sliding contact with the seal member, whereby a sliding contact portion thereof is heated due to friction. Therefore, when a rotational speed of the developing roller is increased in order to increase a printing speed, the sliding contact portion becomes to have a high temperature and toner melts in the sliding contact portion, and thus there is a concern that toner leakage may occur.

SUMMARY

Accordingly, an aspect of the present invention provides a developing device, a process cartridge, and an image forming apparatus which can radiate heat in a sliding contact portion between a developing roller and a seal member.

According to an illustrative embodiment of the present invention, there is provided a developing device comprising: a casing configured to accommodate developer; a developing roller; a seal member, at least a portion of which is disposed between the developing roller and the casing, the seal member including a fabric member including a plurality of first fibers extending in a first direction; and a heat radiation member configured to contact end surfaces of the plurality of first fibers of the seal member and radiate heat of the seal member.

According to another illustrative embodiment of the present invention, there is provided a process cartridge comprising a developing cartridge and a drum unit. The developing cartridge includes: a casing configured to accommodate developer; a developing roller; and a seal member, at least portion of which is disposed between the developing roller and the casing, the seal member including a fabric member including a plurality of fibers extending in a first direction. The drum unit includes a photosensitive drum disposed to face the developing roller, and on which the developing cartridge is configured to be removably mounted. The drum unit further includes a heat radiation member configured to radiate heat of the seal member though the end surfaces of the first fibers of the seal member.

According to the above configurations, it is possible to radiate heat in the sliding contact portion between the developing roller and the seal member.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIG. 11A is viewed from a direction of an arrow A;

FIG. 12A is viewed from a direction of an arrow B;

FIG. 26 is a table showing thermally-conductive adhesives which are used in examples.

DETAILED DESCRIPTION

First Illustrative Embodiment

Figure 1:
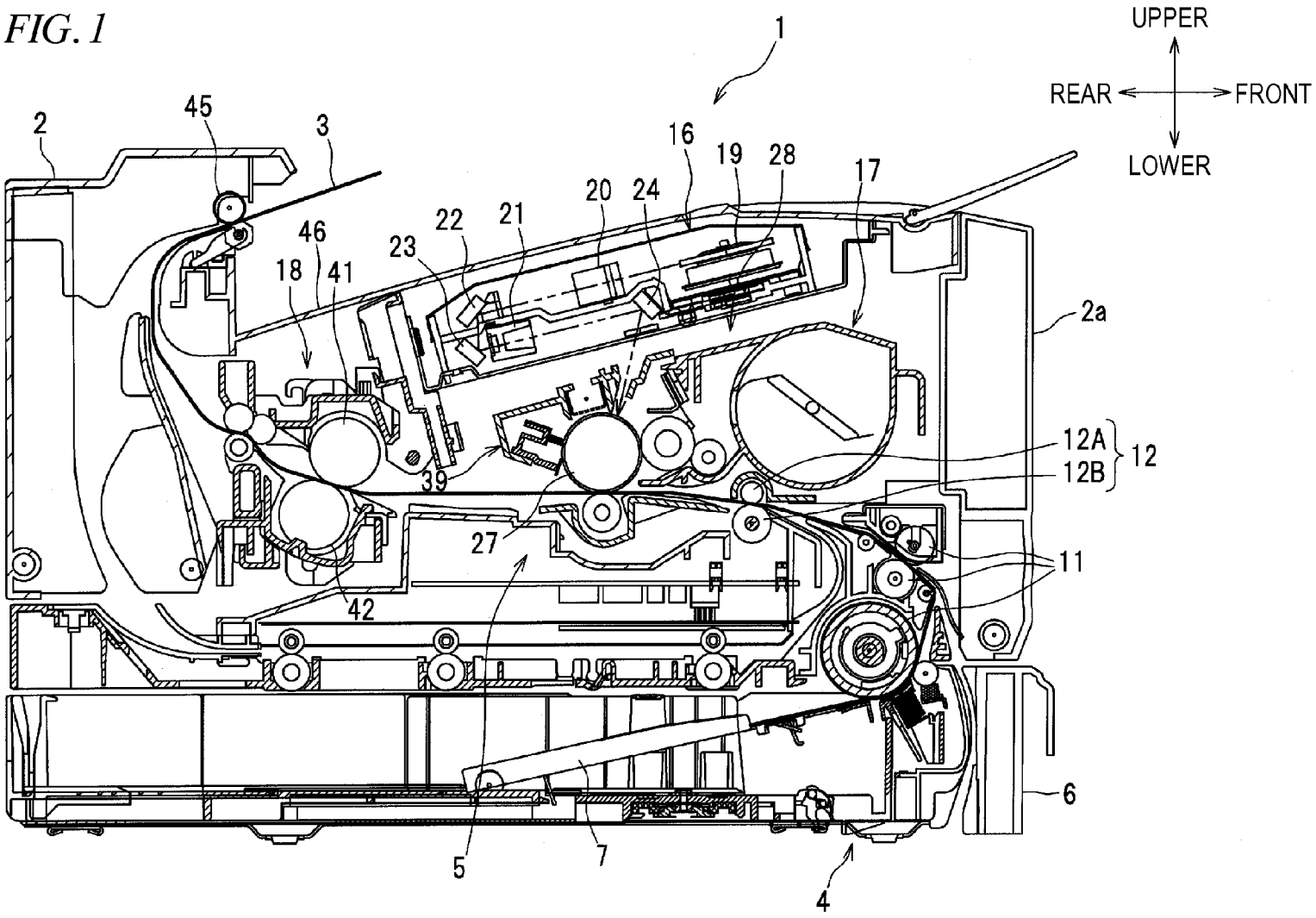
FIG. 1 is a cross-sectional view showing a laser printer including a developing cartridge according to a first illustrative embodiment of the present invention.

Next, a first illustrative embodiment of the present invention will be described in detail appropriately referring to the drawings. In the following description, first, the overall configuration of a laser printer is briefly described, and thereafter, the details of illustrative embodiments of the present invention are described.

Further, in the following description, description will be made in a direction based on a user during the use of a laser printer 1. That is, the right side in FIG. 1 is referred to as the "front", the left side is referred to as the "rear", the front side is referred to as the "left", and the back side is referred to as the "right". Further, a vertical direction in FIG. 1 is referred to as the "upper-lower direction".

As shown in FIG. 1, the laser printer 1 includes a main body casing 2 (an example of an apparatus main body), a feeder section 4 for feeding sheet 3 (an example of a recording sheet), and an image forming section 5 for forming an image on the sheet 3.

The feeder section 4 includes a sheet feed tray 6 which is removably mounted on a bottom portion in the main body casing 2, and a sheet pressing plate 7 which is provided in the sheet feed tray 6. Further, the feeder section 4 includes various rollers 11 which perform the transport of the sheet 3 or sheet dust removal, and a registration roller 12. The registration roller 12 includes a pinch roller 12A (an example of a transport roller) and a main body-side transport roller 12B which is disposed below the pinch roller 12A and faces the pinch roller 12A in the vertical direction. The structure around the pinch roller 12A will be described in detail later, when necessary. Then, in the feeder section 4, the sheet 3 in the sheet feed tray 6 is pressed upward by the sheet pressing plate 7 and transported to the image forming section 5 by various rollers 11 or the registration roller 12.

The image forming section 5 includes a scanner unit 16, a process cartridge 17, and a fixing section 18.

The scanner unit 16 is provided at an upper portion in the main body casing 2 and includes a laser emission section (not shown), a polygon mirror 19 which is rotationally driven, lenses 20 and 21, reflecting mirrors 22, 23, and 24, and the like. In the scanner unit 16, a laser beam is irradiated at high-speed scanning onto the surface of a photosensitive drum 27 along a path shown by a chain line in FIG. 1.

The process cartridge 17 is configured to be removably mountable to the main body casing 2 by appropriately opening a front cover 2*a* provided on the front side of the main body casing 2. The process cartridge 17 includes a developing cartridge 28 (an example of a developing device) and a drum unit 39 on which the developing cartridge 28 can be removably mounted.

Figure 2:
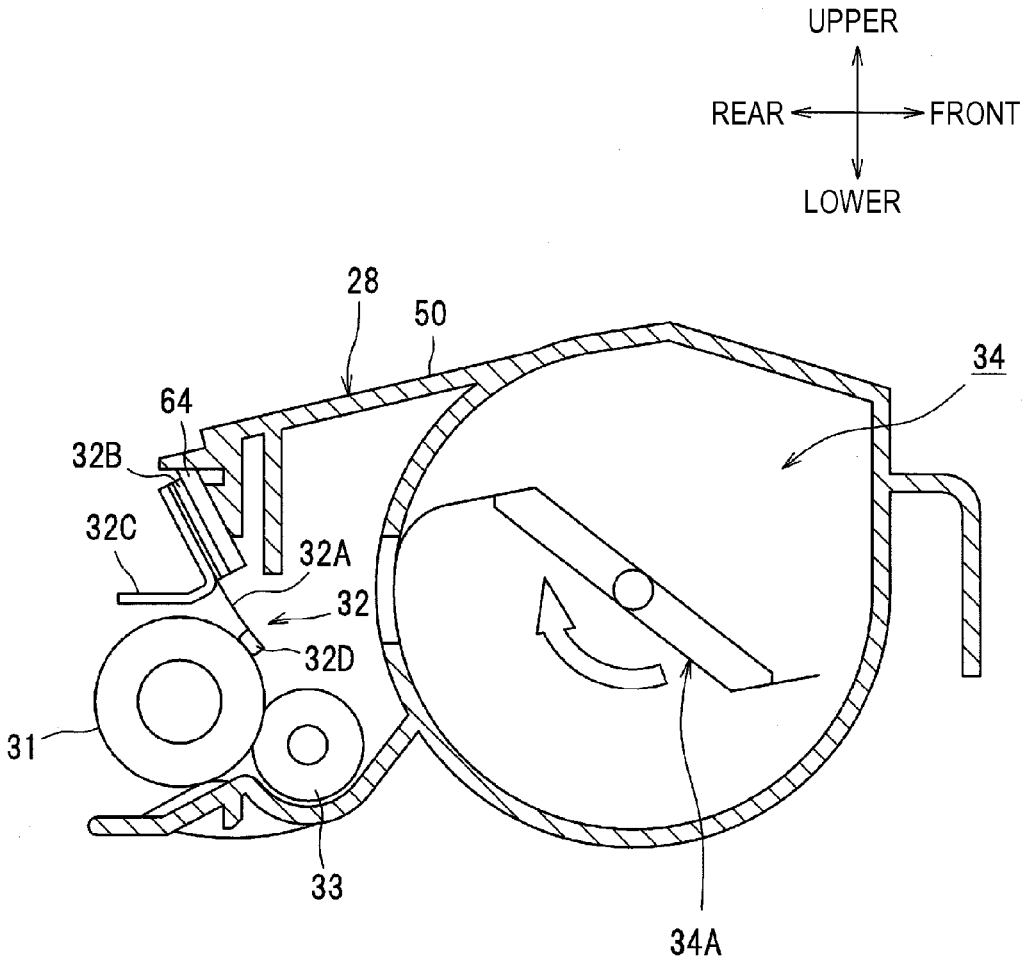
FIG. 2 is a cross-sectional view showing the developing cartridge.

The developing cartridge 28 is configured to be removably mountable to the main body casing 2 in a state of being mounted on the drum unit 39. The developing cartridge 28 may be configured to be removably mountable to the drum unit 39 which is fixed to the main body casing 2. The developing cartridge 28 includes a developing roller 31, a layer thickness regulating blade 32, a supply roller 33, and a toner accommodation chamber 34, as shown in FIG. 2.

In the developing cartridge 28, toner (an example of developer) accommodated in the toner accommodation chamber 34 is agitated by an agitator 34A and then supplied to the developing roller 31 by the supply roller 33, and at this time, the toner is positively frictionally charged between the supply roller 33 and the developing roller 31. The toner supplied onto the developing roller 31 enters between the layer thickness regulating blade 32 and the developing roller 31 with the rotation of the developing roller 31 and is carried on the developing roller 31 with the toner regulated to a thin layer having a constant thickness while being further frictionally charged. The details of the developing cartridge 28 will be described later.

As shown in FIG. 1, the drum unit 39 includes a photosensitive drum 27, a scorotron type charger 29, and a transfer roller 30.

In the drum unit 39, the surface of the photosensitive drum 27 is positively and uniformly charged by the scorotron type charger 29 and then exposed by high-speed scanning of a laser beam from the scanner unit 16. Accordingly, a potential of an exposed portion is lowered, whereby an electrostatic latent image based on image data is formed.

Subsequently, due to the rotation of the developing roller 31, the toner carried on the developing roller 31 is supplied to the electrostatic latent image which is formed on the surface of the photosensitive drum 27, and thus a toner image is formed on the surface of the photosensitive drum 27. Thereafter, the sheet 3 is transported between the photosensitive drum 27 and the transfer roller 30, whereby the toner image carried on the surface of the photosensitive drum 27 is transferred onto the sheet 3.

The fixing section 18 includes a heating roller 41 and a pressing roller 42 which is disposed to face the heating roller 41 and presses the heating roller 41. In the fixing section 18, the toner transferred onto the sheet 3 is thermally fixed while the sheet 3 passes through between the heating roller 41 and the pressing roller 42. In addition, the sheet 3 thermally fixed in the fixing section 18 is transported to a sheet discharge roller 45 which is disposed on the downstream side of the fixing section 18, and sent out from the sheet discharge roller 45 onto a sheet discharge tray 46.

<Detailed Structure of Developing Cartridge>

Next, the detailed structure of the developing cartridge 28 according to the first illustrative embodiment of the present invention will be described. Since the developing cartridge 28 has a bilaterally symmetric structure, in FIG. 3 and the like, only a portion on one side of the left and the right is shown and illustration of a portion on the other side is omitted. Further, FIG. 3 shows a state where the developing roller 31, the supply roller 33, and an outer reinforcing plate 32C (refer to FIG. 2 and described later) are removed.

Figure 3:
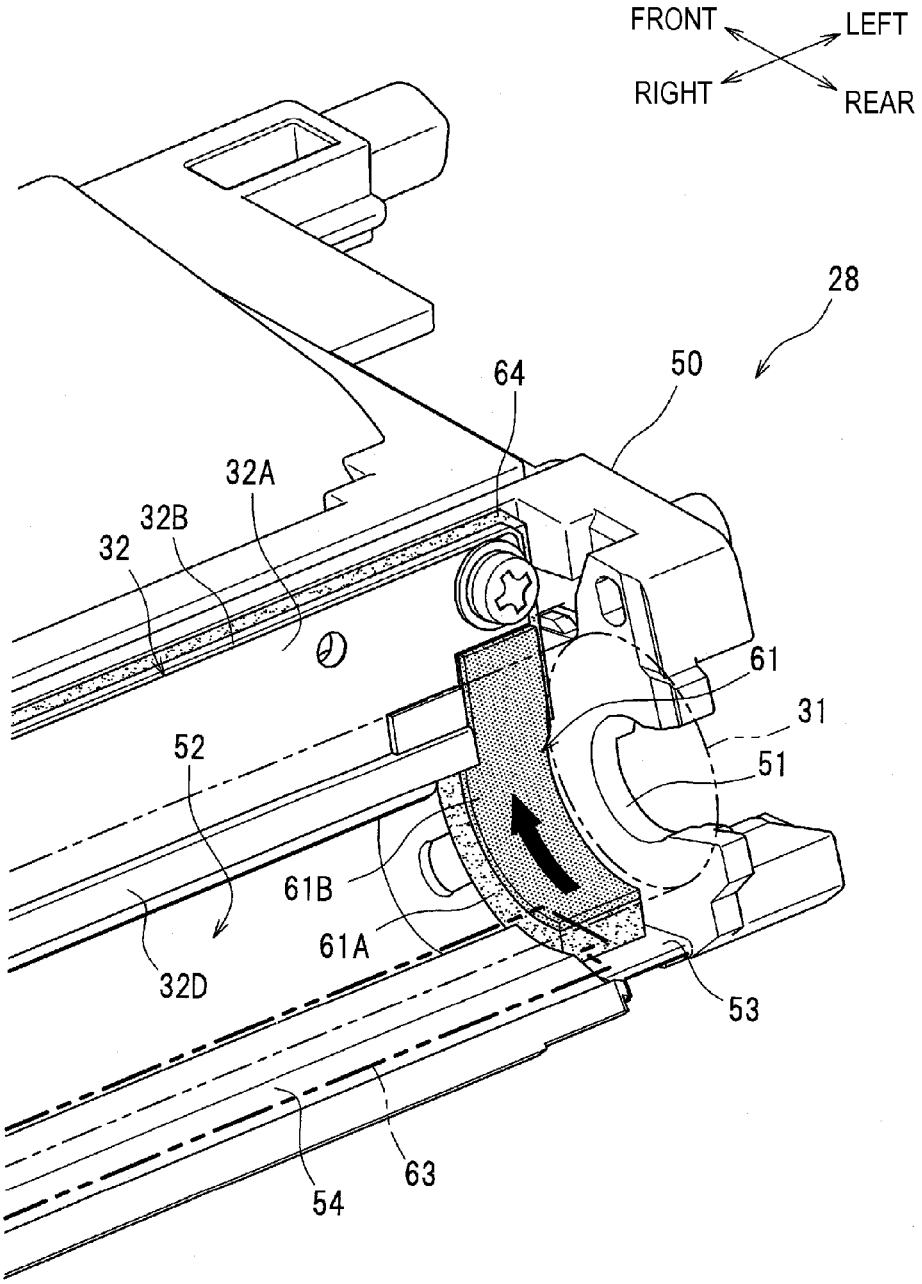
FIG. 3 is a perspective view showing a structure around an opening of a casing.

As shown in FIG. 3, the developing cartridge 28 includes a casing 50 for accommodating toner, a side seal member 61 (an example of a seal member) which comes into sliding contact with each of both end portions of the developing roller 31, a lower film 63, and the like, in addition to the developing roller 31 described above. The developing roller 31 rotates in a direction of an arrow shown in the drawing, that is, rotates so as to come into sliding contact with the lower film 63 and the side seal member 61 in this order.

The casing 50 includes a bearing section 51 which rotatably supports the developing roller 31, an opening 52 for supplying toner from the toner accommodation chamber 34 on the inside to the developing roller 31, a side seal sticking surface 53 to which the side seal member 61 is stuck, and a supporting section 54 which supports the lower film 63. The opening 52 is formed into the form of a rectangular long hole along an axial direction of the developing roller 31, and the layer thickness regulating blade 32 is fixed to an upper portion thereof.

The layer thickness regulating blade 32 has a plate-shaped metal plate 32A which is long in a left-right direction, and a pressing member 32D which is made of rubber and fixed to a lower end portion (a tip end portion) of the metal plate 32A. The pressing member 32D is formed such that the left-right width thereof is smaller than that of the metal plate 32A. Further, both end portions in the left-right direction of the pressing member 32D are in contact with fabric members 61B.

As shown in FIG. 2, at an upper end portion (an end portion on the opposite side to an end portion which comes into contact with the developing roller 31) of the layer thickness regulating blade 32, a pair of reinforcing plates 32B and 32C (an example of a heat radiation member), which sandwiches and reinforces the upper end portion therebetween, is provided. The layer thickness regulating blade 32 and the pair of reinforcing plates 32B and 32C are fixed to the casing 50 through a known blade back seal 64. In other words, the outer reinforcing plate 32C sandwiches and holds the layer thickness regulating blade 32, the inner reinforcing plate 32B, and the blade back seal 64 between itself and the casing 50. The respective reinforcing plates 32B and 32C will be described in detail later.

As shown in FIG. 3, the side seal sticking surface 53 is a surface having a substantially arcuate shape in a cross-sectional view and the side seal sticking surfaces 53 are formed on both left and right sides of the opening 52. The side seal member 61 is provided on the side seal sticking surface 53. The side seal member 61 will be described in detail later.

The supporting section 54 is formed so as to protrude further to the developing roller 31 side than the side seal sticking surface 53 and extend along the axial direction of the developing roller 31. The lower film 63 is provided on the upper surface of the supporting section 54.

The lower film 63 is a sheet-like member made of resin such as polyethylene terephthalate and extends along the axial direction of the developing roller 31 to come into sliding contact with approximately the entirety of the developing roller 31. Then, the lower film 63 is formed longer in the left-right direction than the supporting section 54 and disposed such that in a state where the lower film 63 is stuck to the supporting section 54, both end portions thereof protrude from the supporting section 54, thereby overlapping the side seal members 61. Accordingly, toner leakage between the side seal member 61 and the lower film 63 is suppressed.

Figure 4:
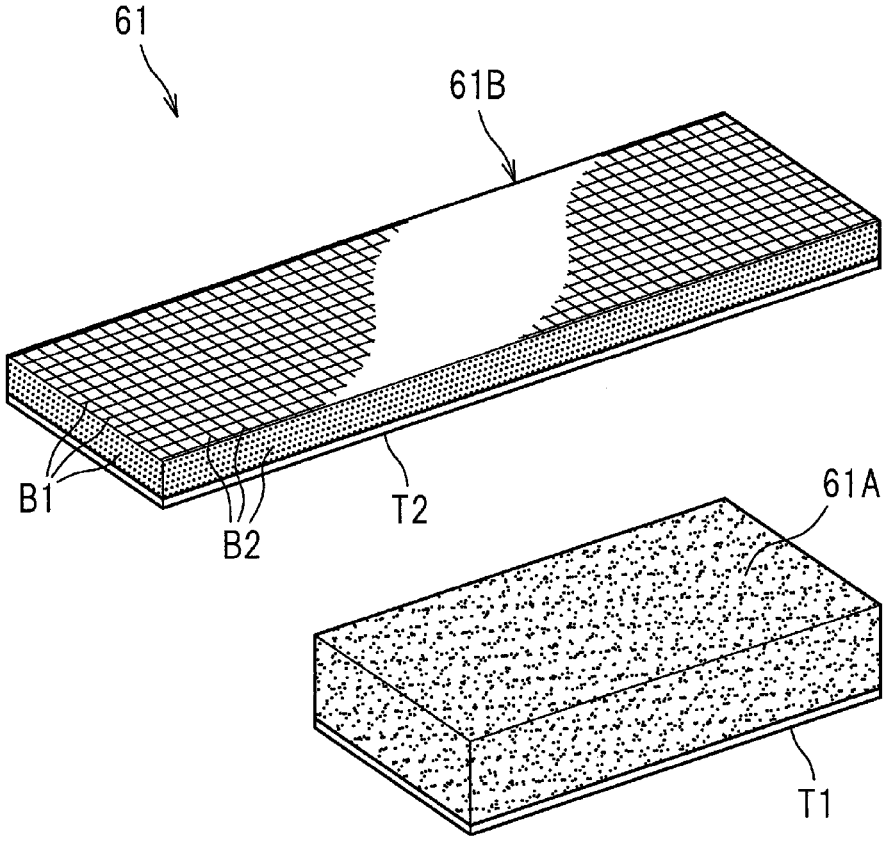
FIG. 4 is an exploded perspective view showing a side seal member in a simplified manner.
Figure 5A:
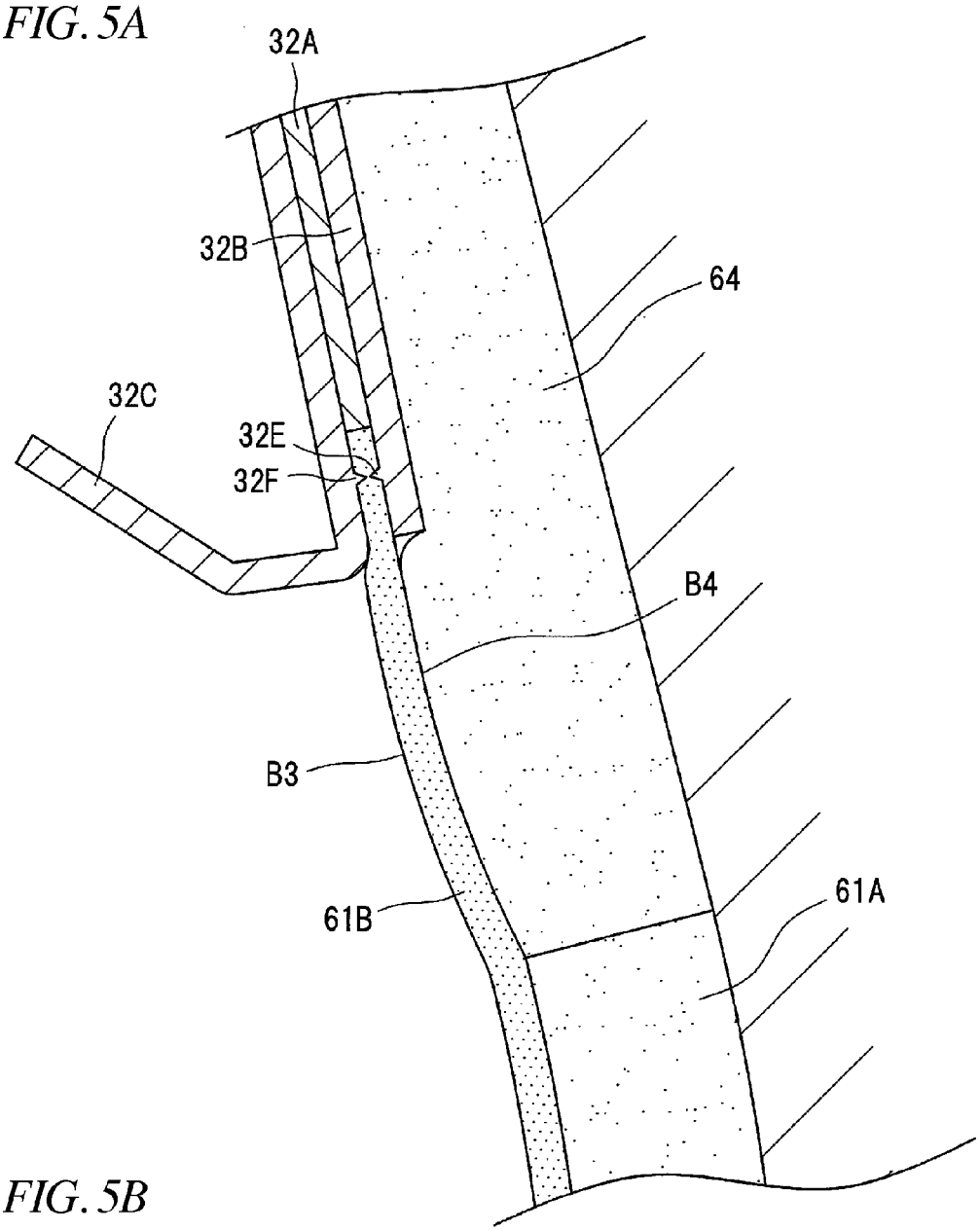
FIG. 5A is a cross-sectional view showing a state where the side seal member is mounted on the casing.

The side seal member 61 is a member for suppressing toner leakage from the gap between each of both end portions of the developing roller 31 which is disposed so as to face the opening 52 of the casing 50 and the side seal sticking surface 53, and is provided between each of both end portions of the developing roller 31 and the side seal sticking surface 53. As shown in FIGS. 4 and 5, the side seal member 61 includes a base material 61A having elasticity, and the fabric member 61B which is laminated on the surface on the developing roller 31 side of the base material 61A.

The base material 61A is formed of an elastic body such as an elastically-deformable urethane sponge and is stuck to the side seal sticking surface 53 of the casing 50 by a double-sided tape T1 so as to be adjacent to a lower end of the blade back seal 64. In FIG. 5, for ease of understanding, the double-sided tapes T1 and T2 are not illustrated.

The fabric member 61B is formed into a long sheet shape extending along the rotation direction of the developing roller 31 and is configured by interweaving a plurality of longitudinal fibers B1 extending in a longitudinal direction and a lateral fiber B2 extending in a short side direction so as to intersect (cross) each other. With respect to the diameter of each of the fibers B1 and B2 of the fabric member 61B, the diameter of the longitudinal fiber B1 is about 150 μm and the diameter of the lateral fiber B2 is about 200 μm. Further, with respect to the weave, twill weave or satin weave may be preferable. Here, the longitudinal direction (the rotation direction of the developing roller 31) is an example of a first direction and the short side direction (the axial direction of the developing roller 31) is an example of a second direction.

Specifically, the longitudinal fiber B1 is provided in plural in the short side direction of the fabric member 61B and also provided in plural in the thickness direction of the fabric member 61B. Further, the lateral fiber B2 is provided in plural in the longitudinal direction of the fabric member 61B and also provided in plural in the thickness direction of the fabric member 61B. For example, in FIG. 3, 5A, or the like, the respective fibers B1 and B2 are appropriately omitted in consideration of the visibility of the drawing.

Each of the fibers B1 and B2 has a circumferential surface in which a heat radiation amount per unit area is a first heat radiation amount, and an end surface in which a heat radiation amount per unit area is a second heat radiation amount larger than the first heat radiation amount. Specifically, as each of the fibers B1 and B2 having such properties, it is possible to adopt a fiber having a molecular structure in which molecules are arranged linearly, and it is possible to adopt, for example, an ultrahigh molecular weight polyethylene or PBO (polyparaphenylenebenzobisoxazole) fiber or the like. In addition, specifically, a fiber may be preferable in which thermal conductivity (at 100K) in a direction toward the end surface is equal to or greater than 0.1 W/cm·K and equal to or less than 1.0 W/cm·K, and is equal to or greater than two to 50 times of the thermal conductivity in a circumferential surface direction. In this illustrative embodiment, the Dyneema (registered trademark) SK60 fiber manufactured by Toyobo Co., Ltd. is used.

The fabric member 61B is formed so as to be longer than the base material 61A in the longitudinal direction and is stuck to the base material 61A, the blade back seal 64, and the inner reinforcing plate 32B by the double-sided tape T2. The fabric member 61B has a first surface B3 facing the developing roller 31 and a second surface B4 on the side opposite to the first surface B3, and an upper end portion thereof is sandwiched between the pair of reinforcing plates 32B and 32C.

The pair of reinforcing plates 32B and 32C is formed of metal and disposed at a position other than the portion facing the developing roller 31 of the fabric member 61B. The respective reinforcing plates 32B and 32C have protrusions 32E and 32F which are exposed to the outside of the casing 50 and protrude to the fabric member 61B side in the surfaces sandwiching the fabric member 61B therebetween.

The protrusions 32E and 32F are for cutting the longitudinal fibers B1 of the fabric member 61B and are each formed into a triangular shape in a cross-sectional view with a tip portion pointed sharply. The protrusions 32E and 32F extend from the right end to the left end of the fabric member 61B in the left-right direction and are disposed at positions facing each other. In addition, the protrusions 32E and 32F may protrude to the outside in the left-right direction of the fabric member 61B. Further, the protrusions 32E and 32F are formed in a size in which the respective tip portions do not come into contact with each other in a state where the respective reinforcing plates 32B and 32C sandwich the metal plate 32A therebetween. That is, the sum of the height of the protrusion 32E and the height of the protrusion 32F is smaller than the thickness of the metal plate 32A.

Figure 5B:
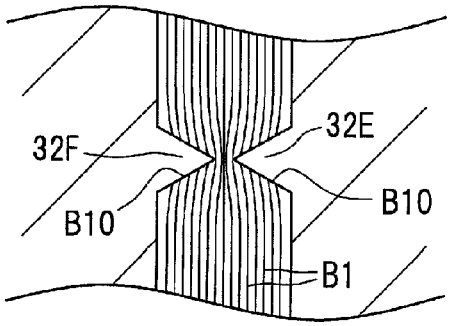
FIG. 5B is a diagram showing a state where cut surfaces of longitudinal fibers and a protrusion are in contact with each other.

The respective reinforcing plates 32B and 32C sandwich the upper end portion of the fabric member 61B therebetween, whereby the fabric member 61B is cut from both sides of the first surface B3 and the second surface B4 by the respective protrusions 32E and 32F to form cutouts while leaving a portion thereof uncut, as shown in FIG. 5B. Due to such a configuration, cut surfaces B10 (end surfaces) of the respective longitudinal fibers B1 come into contact with the respective protrusions 32E and 32F of the respective reinforcing plates 32B and 32C.

Therefore, since heat generated at the sliding contact portion between the developing roller 31 and the fabric member 61B can be transmitted from the cut surfaces B10 of the respective longitudinal fibers B1 to the respective protrusions 32E and 32F, it becomes possible to radiate the heat through the respective reinforcing plates 32B and 32C. In addition, the respective reinforcing plates 32B and 32C are also in contact with the planar surface of the fabric member 61B (the circumferential surface of the longitudinal fiber B1), and thus heat is also radiated from here. However, since a heat radiation amount per unit area is larger at an the end surface of a fiber than the circumferential surface of a fiber, heat radiation efficiency in a portion which is in contact with each of the protrusions 32E and 32F from the cut surface B10 of each longitudinal fiber B1 becomes larger.

In the above-described developing cartridge 28, as shown in FIG. 3, when the developing roller 31 rotates, both end portions of the developing roller 31 and the surfaces on the developing roller 31 side of the fabric members 61B come into sliding contact with each other. Then, when heat is generated from the sliding contact portion between the developing roller 31 and the fabric member 61B, the heat is transmitted along each longitudinal fiber B1 and then efficiently transmitted from the cut surface B10 of each longitudinal fiber B1 to each of the protrusions 32E and 32F of the respective reinforcing plates 32B and 32C. Further, heat is also transmitted from the circumferential surfaces of the fibers to the respective reinforcing plates 32B and 32C.

Incidentally, the heat radiation member is not in contact with the end surface on the lower side of the longitudinal fiber B1. Specifically, since the end surface is in contact with air, a heat radiation amount from the end surface is smaller. Further, since the heat radiation member is also not in contact with the end surface of each lateral fiber B2 (the end surface is in contact with air), a heat radiation amount from the end surface is smaller and the heat of each lateral fiber B2 is transmitted to each longitudinal fiber B1 having a relatively low temperature.

Then, heat transmitted from the cut surface B10 of each longitudinal fiber B1 to each of the protrusions 32E and 32F of the respective reinforcing plates 32B and 32C is radiated to the outside of the casing 50 through each of the reinforcing plates 32B and 32C. Therefore, according to this illustrative embodiment, it is possible to allow the heat generated at the sliding contact portion between the developing roller 31 and the side seal member 61 to escape through the respective reinforcing plates 32B and 32C.

Further, since the respective reinforcing plates 32B and 32C can be brought into contact with the cut surfaces B10 (the end surfaces) of the respective longitudinal fibers B1 by cutting the fabric member 61B by the respective reinforcing plates 32B and 32C, compared to a structure of bringing the respective reinforcing plates 32B and 32C into contact with only the planar surface of the fabric member 61B (the circumferential surfaces of the fibers), it is possible to allow heat transmitted to the respective longitudinal fibers B1 to efficiently escape to the respective reinforcing plates 32B and 32C. In addition, since the fabric member 61B is cut by the respective reinforcing plates 32B and 32C while leaving a portion thereof uncut, compared to a configuration of completely cutting the fabric member 61B, separation of the respective reinforcing plates 32B and 32C from the cut surfaces of the respective longitudinal fibers B1 is suppressed, and thus the fabric member 61B can be held by the respective reinforcing plates 32B and 32C as it is.

Further, since the fabric member 61B is cut from both sides of the first surface B3 and the second surface B4 while leaving a portion thereof uncut, it is possible to bring the respective reinforcing plates 32B and 32C into contact with the cut surfaces B10 of the respective longitudinal fibers B1 at both the first surface B3 and the second surface B4 of the fabric member 61B.

Further, since each of the reinforcing plates 32B and 32C (the heat radiation member) is disposed at a position other than the portion facing the developing roller 31 of the fabric member 61B, compared to, for example, a configuration in which a heat radiation member is disposed at a portion facing the developing roller 31, it is possible to suppress the contact of the developing roller 31 with the heat radiation member.

Further, since the respective reinforcing plates 32B and 32C have the protrusions 32E and 32F, the fibers can be easily cut by the respective protrusions 32E and 32F of the respective reinforcing plates 32B and 32C.

The first illustrative embodiment of the present invention has been described above. However, the present invention is not limited to the above-described illustrative embodiment. With respect to the specific configuration, a change can be appropriately made within a scope which does not depart from the gist of the present invention. In the following description, approximately the same configurations as those in the above-described illustrative embodiment are denoted by the same reference numerals as those in the illustrative embodiment and description thereof is omitted.

Second Illustrative Embodiment

Figure 6A:
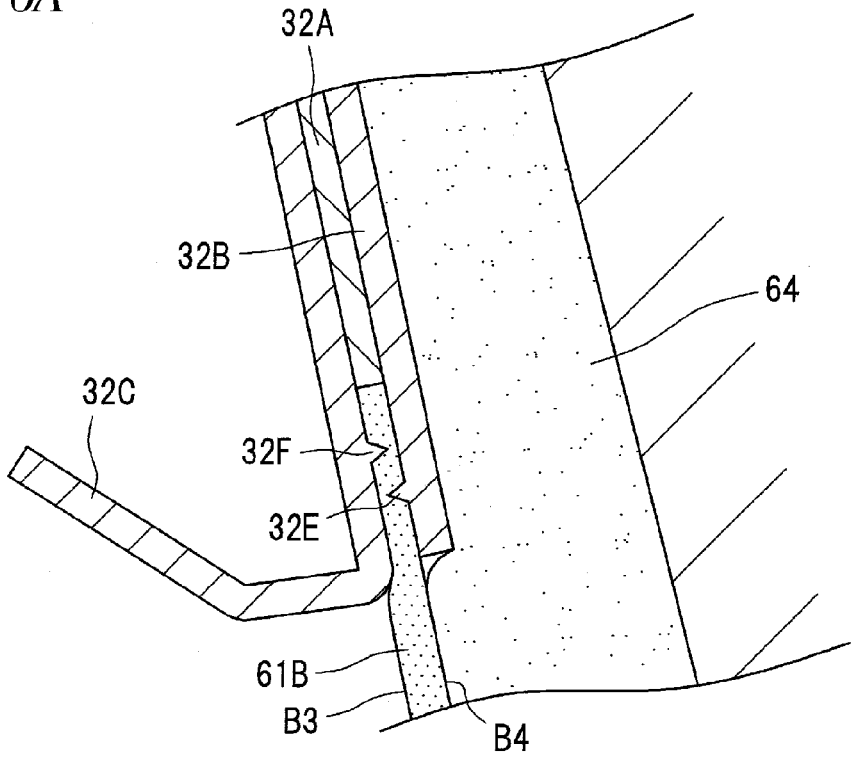
FIG. 6A is a diagram equivalent to FIG. 5A showing the periphery of the protrusion in a second illustrative embodiment.

In the first illustrative embodiment, the respective protrusions 32E and 32F of the respective reinforcing plates 32B and 32C face each other. However, the present invention is not limited thereto, and as shown in, for example, FIG. 6A, the respective protrusions 32E and 32F may be disposed at positions which do not face each other. Even in such a configuration, similar to the first illustrative embodiment, since heat generated at the sliding contact portion between the developing roller 31 and the side seal member 61 can be transmitted from the cut surfaces of the respective longitudinal fibers to the respective protrusions 32E and 32F, it is possible to efficiently radiate heat through the respective reinforcing plates 32B and 32C.

Third Illustrative Embodiment

Figure 6B:
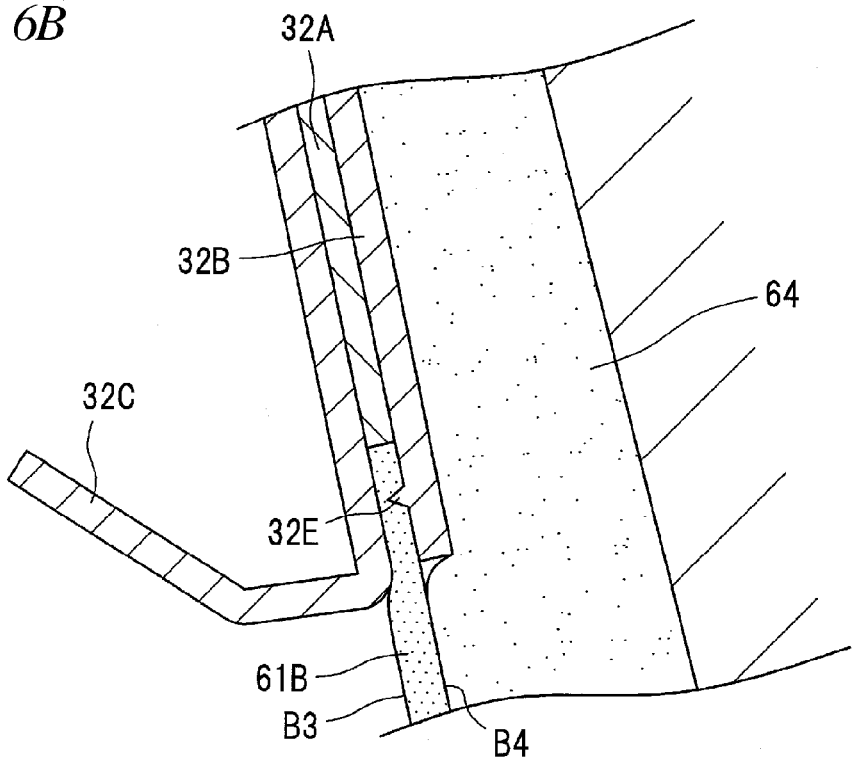
FIG. 6B is a diagram equivalent to FIG. 5A showing the periphery of the protrusion in a third illustrative embodiment.

In the illustrative embodiments described above, the fabric member 61B is cut from both sides of the first surface B3 and the second surface B4 by the protrusions 32E and 32F while leaving a portion thereof uncut. However, a configuration may be also employed in which the fabric member 61B is cut from only one side of the first surface B3 and the second surface B4 while leaving a portion thereof uncut. As shown in, for example, FIG. 6B, a configuration may be also employed in which the protrusion 32E is formed at the inner reinforcing plate 32B and a protrusion is not formed at the outer reinforcing plate 32C. Even in such a configuration, it is possible to cut the fabric member 61B from the second surface B4 side by the protrusion 32E while leaving a portion thereof uncut. Therefore, similar to the illustrative embodiments described above, since heat generated at the sliding contact portion between the developing roller 31 and the side seal member 61 can be transmitted from the cut surface of each longitudinal fiber to the protrusion 32E, it is possible to efficiently radiate heat through the inner reinforcing plate 32B.

Fourth Illustrative Embodiment

In the illustrative embodiments described above, the pair of reinforcing plates 32B and 32C is used as the heat radiation member. However, the present invention is not limited thereto and a member other than the reinforcing plates 32B and 32C may be used as the heat radiation member.

Figure 7:
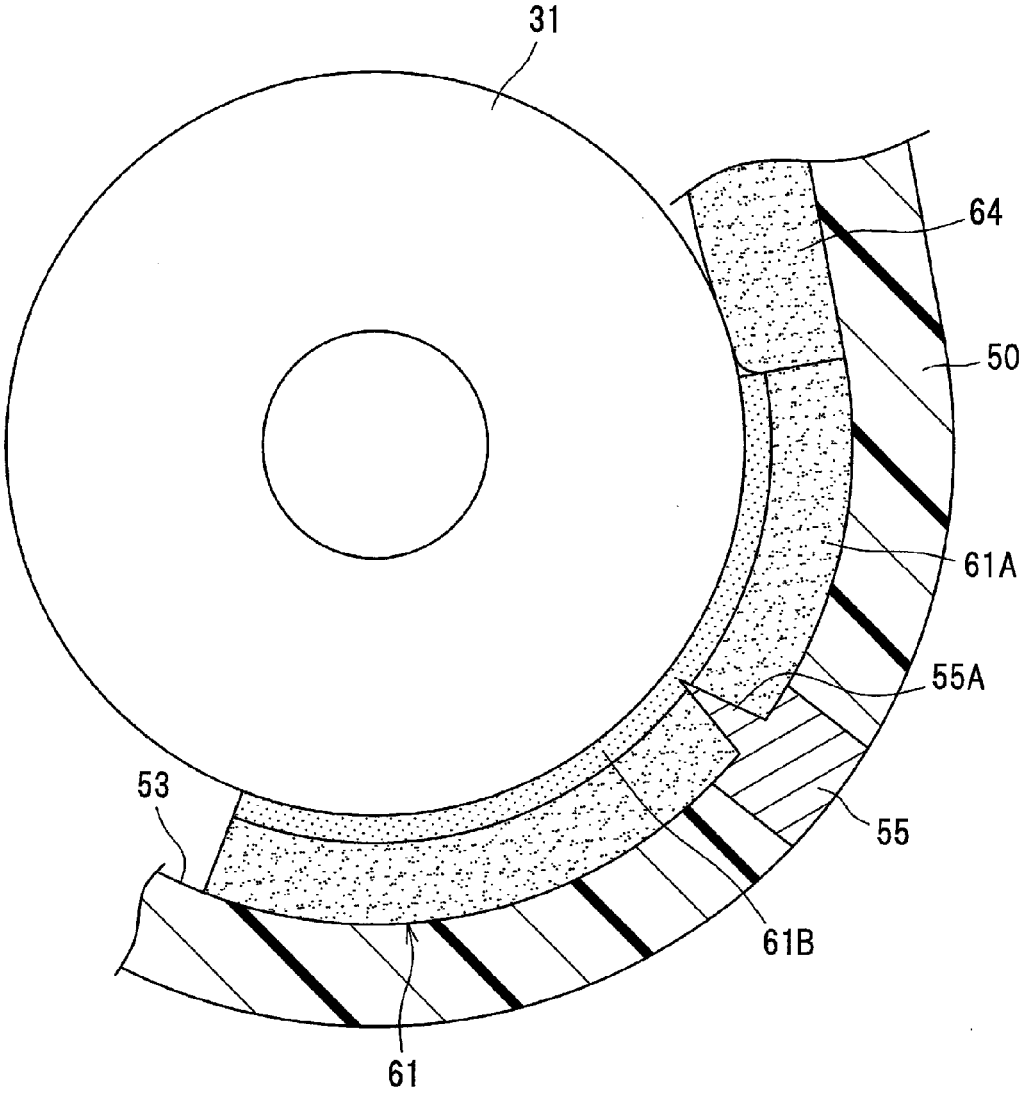
FIG. 7 is an enlarged view showing the periphery of a heat radiation member in a fourth illustrative embodiment.

As shown in, for example, FIG. 7, a metal member 55 embedded in the casing 50 may be used as the heat radiation member.

The metal member 55 is embedded in a portion forming the side seal sticking surface 53 in the casing 50 by insert molding or the like and the outer surface thereof is exposed to the outside of the casing 50. Further, the metal member 55 has a protrusion 55A which protrudes from the side seal sticking surface 53 to the developing roller 31 side.

The protrusion 55A is formed into a triangular shape in a cross-sectional view with a tip portion pointed sharply and extends from the right end to the left end of the side seal member 61 in the left-right direction. The protrusion 55A is made smaller than the thickness of the side seal member 61 and larger than the thickness of the base material 61A. The side seal member 61 is stuck to the side seal sticking surface 53, whereby the protrusion 55A of the metal member 55 penetrates the base material 61A, thereby cutting the fabric member 61B while leaving a portion thereof uncut. Even in such a configuration, since the cut surface of the fabric member 61B and the protrusion 55A are in contact with each other, similar to the illustrative embodiments described above, heat generated at the sliding contact portion between the developing roller 31 and the side seal member 61 can be transmitted from the cut surface of each longitudinal fiber to the protrusion 55A. Therefore, it is possible to allow the heat to escape to the outside of the casing 50 through the metal member 55.

In the first to fourth illustrative embodiments described above, the developing cartridge 28 integrally having the toner accommodation chamber 34 is illustrated as the developing device. However, the present invention is not limited thereto and the developing device may be, for example, a so-called process cartridge including a developing unit or a photosensitive drum on which a toner cartridge having a toner accommodation chamber is removably mounted, and a developing roller.

In the first to fourth illustrative embodiments described above, the laser printer is illustrated as an image forming apparatus on which the developing device is mounted. However, the present invention is not limited thereto and other image forming apparatuses such as a color printer or a multifunction machine, for example, may be also employed.

In the first to fourth illustrative embodiments described above, the side seal member 61 has a two-layer structure. However, the present invention is not limited thereto and a three or more layered structure may be also employed as long as it has a fabric member. Further, the seal member is not limited to the side seal member 61 as long as it is a seal member which comes into sliding contact with a developing roller, and for example, in a case where a seal member is provided in place of the lower film 63, the present invention may be applied to the seal member.

In the first to fourth illustrative embodiments described above, all of the respective members configuring the heat radiation member are formed of metal. However, the present invention is not limited thereto, and the members may be formed of, for example, thermally-conductive resin.

Fifth Illustrative Embodiment

Next, a fifth illustrative embodiment of the present invention will be described. The overall configuration of the laser printer is approximately the same configuration as that in the first illustrative embodiment, and thus configurations in this illustrative embodiment are denoted by the same reference numerals as those in the first illustrative embodiment and description thereof is omitted. The configuration of a developing cartridge different from that in the first illustrative embodiment will be described.

<Detailed Structure of Developing Cartridge>

The detailed structure of the developing cartridge 1028 according to the fifth illustrative embodiment of the present invention will be described. Since the developing cartridge 1028 has a bilaterally symmetric structure, in FIG. 9 and the like, only a portion on one side of the left and the right is shown and illustration of a portion on the other side is omitted. FIG. 9 shows a state where the developing roller 1031, the supply roller 1033, and the outer reinforcing plate 1032C (described later) (refer to FIG. 8) are removed.

As shown in FIG. 9, the developing cartridge 1028 includes a casing 1050 for accommodating toner, a side seal member 1061 (an example of a seal member) which comes into sliding contact with each of both end portions of the developing roller 1031, a lower film 1063, and the like, in addition to the developing roller 1031 described above and the like. In addition, the developing roller 1031 rotates in a direction of an arrow shown in the drawing, that is, rotates so as to come into sliding contact with the lower film 1063 and the side seal member 1061 in this order.

The casing 1050 includes a bearing section 1051 which rotatably supports the developing roller 1031, an opening 1052 for supplying toner from the toner accommodation chamber 1034 on the inside to the developing roller 1031, a side seal sticking surface 1053 to which the side seal member 1061 is stuck, and a supporting section 1054 which supports the lower film 1063. The opening 1052 is formed into the form of a rectangular long hole along the axial direction of the developing roller 1031, and the layer thickness regulating blade 1032 is fixed to an upper portion thereof.

The layer thickness regulating blade 1032 has the plate-shaped metal plate 1032A which is long in the left-right direction, and the elastically-deformable pressing member 1032D which is fixed to the lower end portion (the tip end portion) of the metal plate 1032A. The pressing member 1032D is a rubber member which comes into contact with the developing roller 1031, and is formed such that the left-right width thereof is smaller than that of the metal plate 1032A. Further, both end portions in the left-right direction of the pressing member 1032D are in contact with the fabric members 1061B (refer to FIG. 11A).

Figure 8:
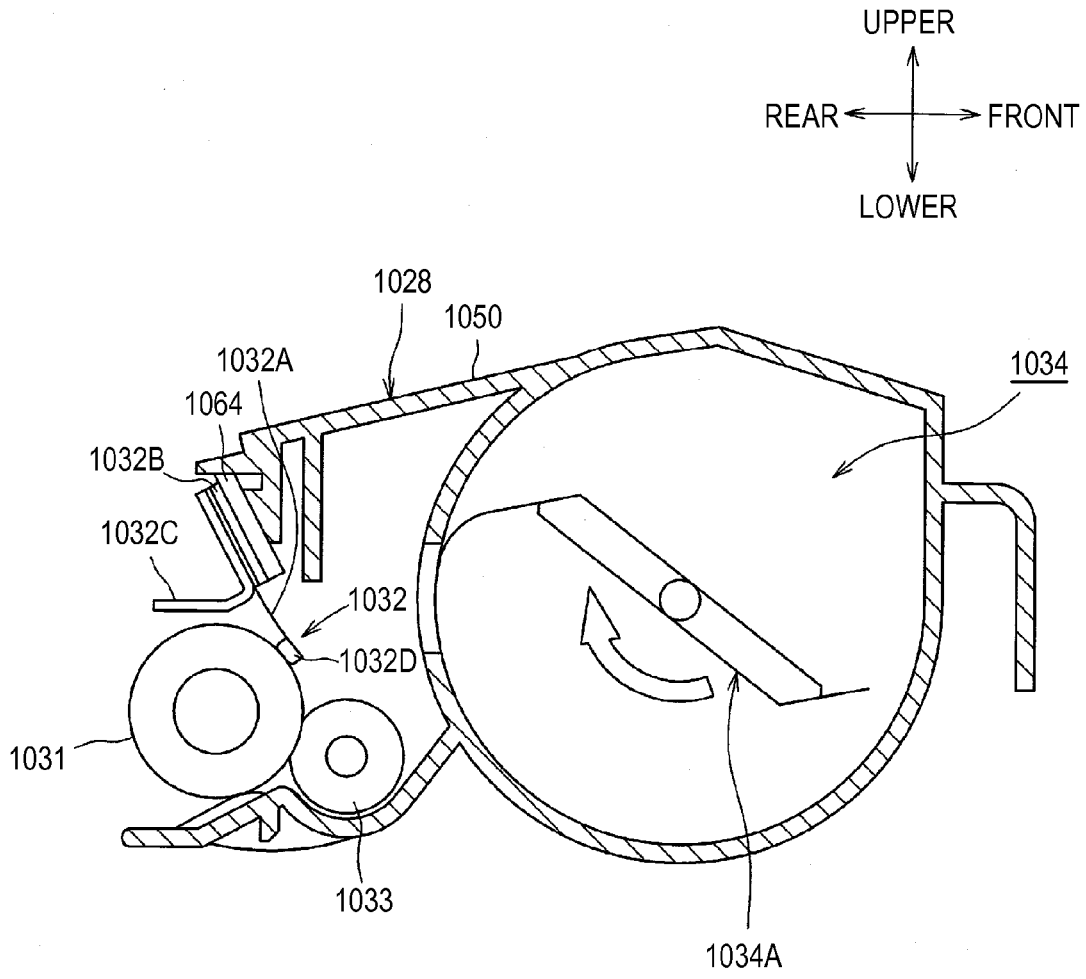
FIG. 8 is a cross-sectional view showing a developing cartridge according to a fifth illustrative embodiment.
Figure 9:
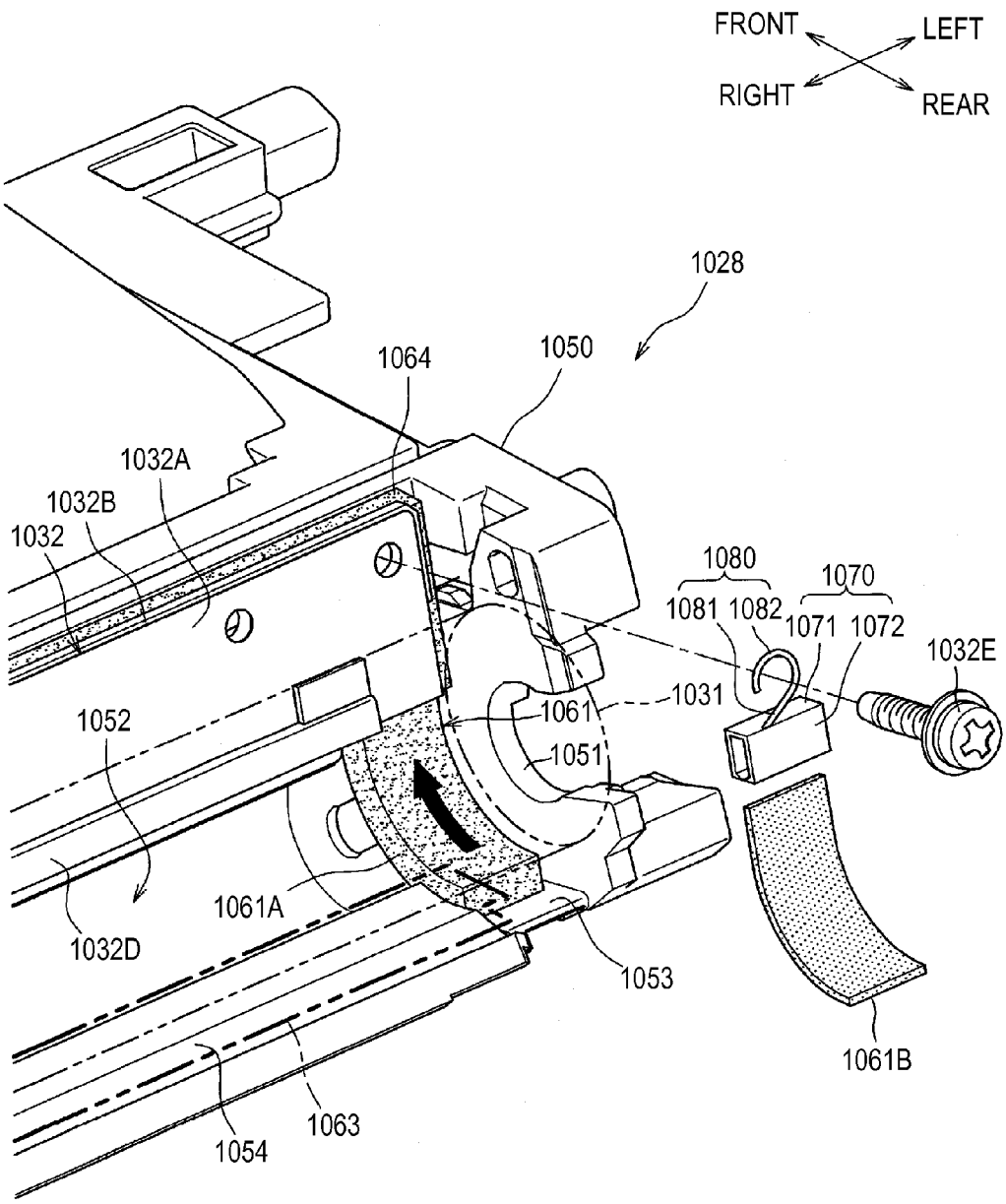
FIG. 9 is a perspective view showing a structure around an opening of a casing.

As shown in FIG. 8, at the upper end portion (the end portion on the opposite side to the end portion which comes into contact with the developing roller 1031) of the layer thickness regulating blade 1032, a pair of reinforcing plates 1032B and 1032C which is made of metal and sandwiches and reinforces the upper end portion therebetween is provided. Then, the layer thickness regulating blade 1032 and the pair of reinforcing plates 1032B and 1032C are fixed to the casing 1050 by a screw 1032E (refer to FIG. 9) through a known blade back seal 1064. In other words, the outer reinforcing plate 1032C (an example of a holding member) sandwiches and holds the layer thickness regulating blade 1032, the inner reinforcing plate 1032B, and the blade back seal 1064 between itself and the casing 1050.

Further, as shown in FIG. 9. a metallic clip member 1070 (an example of a heat transfer member) and a wire spring 1080 (an example of an elastic member) are provided in the casing 1050. The clip member 1070 and the wire spring 180 will be described in detail later.

The side seal sticking surface 1053 is a surface having a substantially arcuate shape in a cross-sectional view and the side seal sticking surfaces 1053 are formed on both left and right sides of the opening 1052. The side seal member 1061 is provided on the side seal sticking surface 1053. The side seal member 1061 will be described in detail later.

The supporting section 1054 is formed so as to protrude further to the developing roller 1031 side than the side seal sticking surface 1053 and extend along the axial direction of the developing roller 1031. The lower film 1063 is provided on the upper surface of the supporting section 1054.

The lower film 1063 is a sheet-like member made of resin such as polyethylene terephthalate and extends along the axial direction of the developing roller 1031 to come into sliding contact with approximately the entirety of the developing roller 1031. Then, the lower film 1063 is formed longer in the left-right direction than the supporting section 1054 and disposed such that in a state where the lower film 1063 is stuck to the supporting section 1054, both end portions thereof protrude from the supporting section 1054, thereby overlapping the side seal members 1061. Accordingly, toner leakage between the side seal member 1061 and the lower film 1063 is suppressed.

Figure 10:
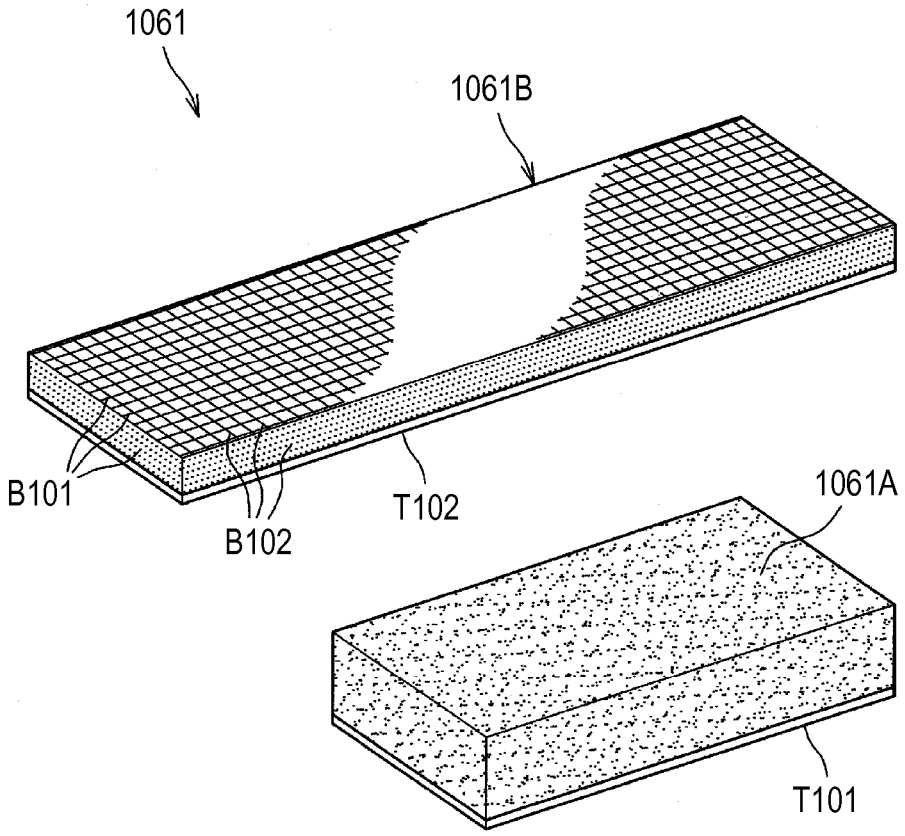
FIG. 10 is an exploded perspective view showing a side seal member in a simplified manner.

The side seal member 1061 is a member for suppressing toner leakage from the gap between each of both end portions of the developing roller 1031 which is disposed so as to face the opening 1052 of the casing 1050 and the side seal sticking surface 1053, and is provided between each of both end portions of the developing roller 1031 and the side seal sticking surface 1053. As shown in FIGS. 10 and 11, the side seal member includes the base material 1061A having elasticity and the fabric member 1061B which is laminated on the surface on the developing roller 1031 side of the base material 1061A.

The base material 1061A is formed of an elastic body such as an elastically-deformable urethane sponge and is stuck to the side seal sticking surface 1053 of the casing 1050 by the double-sided tape T101 so as to be adjacent to the lower end of the blade back seal 1064. In FIG. 11, for ease of understanding, illustration of the double-sided tapes T101 and T102 is omitted.

The fabric member 1061B is formed into a long sheet shape extending along the rotation direction of the developing roller 1031 and is configured by interweaving the plurality of longitudinal fibers B101 extending in the longitudinal direction and the lateral fiber B102 extending in the short side direction so as to intersect each other. Further, with respect to the diameter of each of the fibers B101 and B102 of the fabric member 1061B, the diameter of the longitudinal fiber B101 is about 150 μm and the diameter of the lateral fiber B102 is about 200 μm. Further, with respect to the weave, twill weave or satin weave may be preferable. Here, the longitudinal direction (the rotation direction of the developing roller 1031) is an example of a first direction and the short side direction (the axial direction of the developing roller 1031) is an example of a second direction.

Specifically, the longitudinal fiber B101 is provided in plural in the short side direction of the fabric member 1061B and also provided in plural in the thickness direction of the fabric member 1061B. Further, the lateral fiber B102 is provided in plural in the longitudinal of the fabric member 1061B and also provided in plural in the thickness direction of the fabric member 1061B. For example, in FIG. 8, 11A, 11B, or the like, the respective fibers B101 and B102 are appropriately omitted in consideration of the visibility of the drawing.

Each of the fibers B101 and B102 has a circumferential surface in which a heat radiation amount per unit area is the first heat radiation amount, and an end surface in which a heat radiation amount per unit area is the second heat radiation amount larger than the first heat radiation amount. Specifically, as each of the fibers B101 and B102 having such properties, it is possible to adopt a fiber having a molecular structure in which molecules are arranged linearly, and it is possible to adopt, for example, an ultrahigh molecular weight polyethylene or PBO (polyparaphenylenebenzobisoxazole) fiber or the like. In addition, specifically, a fiber may be preferable in which thermal conductivity (at 100K) in a direction toward the end surface is equal to or greater than 0.1 W/cm·K and equal to or less than 1.0 W/cm·K and is equal to or greater than two to 50 times of the thermal conductivity in a circumferential surface direction. In this illustrative embodiment, the Dyneema (registered trademark) SK60 fiber manufactured by Toyobo Co., Ltd. is used.

The fabric member 1061B is formed so as to be longer than the base material 1061A in the longitudinal direction and is stuck to the base material 1061A and an intermediate member 1065 (described later) by the double-sided tape T102. The fabric member 1061B protrudes further upward than the intermediate member 1065 and an upper end portion thereof is pinched by the clip member 1070 (described later). Accordingly, an end surface B110 (refer to FIG. 11C) of the fabric member 1061B is in contact with the clip member 1070.

Figure 11A:
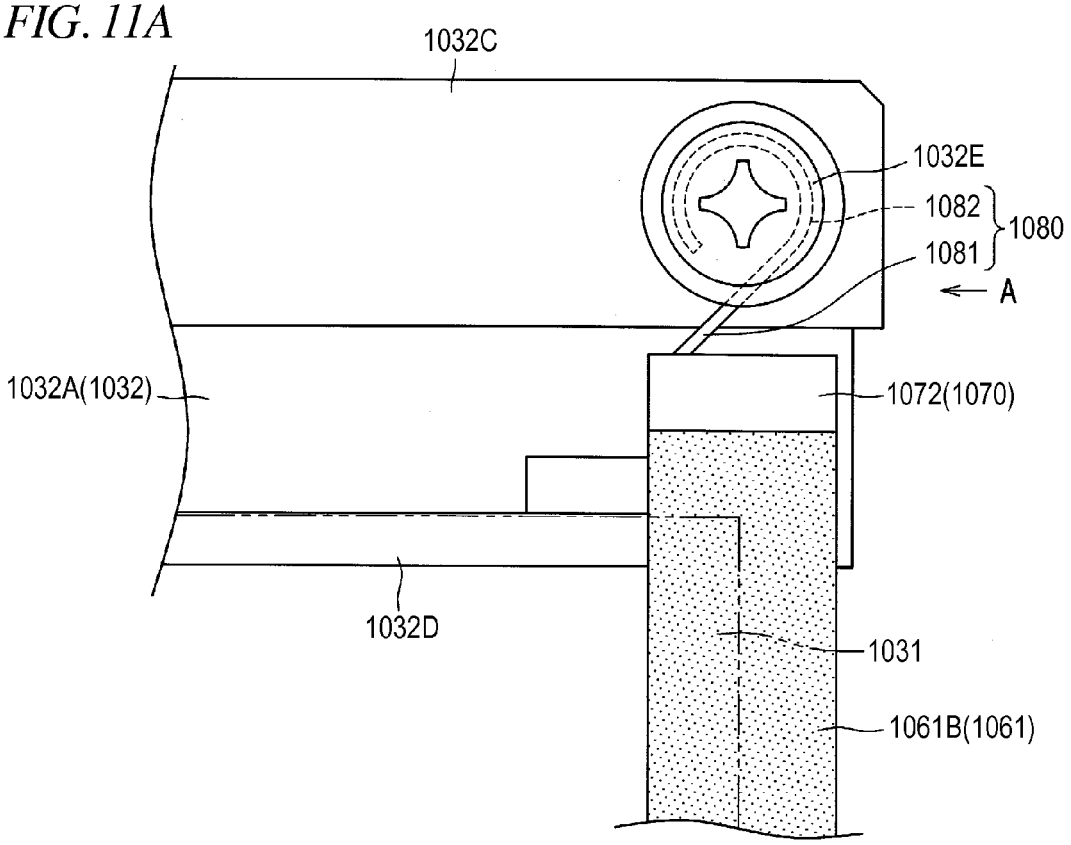
FIG. 11A is a rear view of a state where a side seal member, a clip member, and a reinforcing plate are mounted on a casing.
Figure 11B:
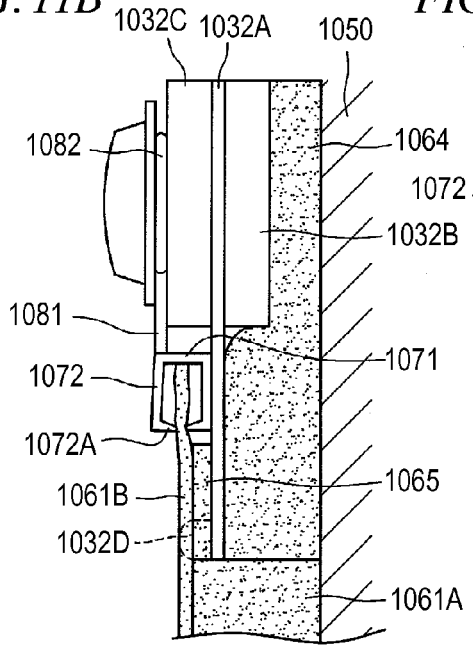
FIG. 11B is a view when

Further, as shown in FIG. 11B, the intermediate member 1065 is disposed between the fabric member 1061B and the metal plate 1032A. The intermediate member 1065 is formed of an elastic body such as an elastically-deformable urethane sponge and is stuck to the metal plate 1032A by a double-sided tape (not shown) or the like. The intermediate member 1065 is disposed in this manner, whereby the height of the fabric member 1061B and the intermediate member 1065 and the height of the pressing member 1032D become equal to each other. Accordingly, a difference in level is eliminated at the boundary between the pressing member 1032D and the side seal member 1061 in each of both end portions in the left-right direction of the developing roller 1031, and thus toner leakage is suppressed.

Figure 11C:
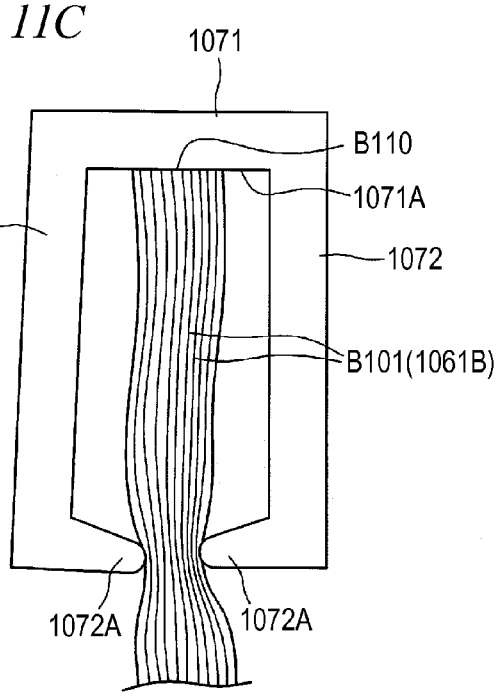
FIG. 11C is an enlarged view of the clip member of FIG. 11B.

The clip member 1070 is a member to fix the fabric member 1061B by elastically pinching the fabric member 1061B, as shown in FIG. 11C, and is disposed at a position other than the portion facing the developing roller 1031 of the fabric member 1061B. The clip member 1070 is made such that the length thereof in the left-right direction is approximately the same as the length in the left-right direction of the fabric member 1061B, and has a contact portion 1071 having a contact surface 1071A which comes into contact with the end surface B110 of the fabric member 1061B (the end surface of the longitudinal fiber B101), and arm portions 1072 sandwiching the fabric member 1061B therebetween.

The contact portion 1071 is formed into a plate shape, faces the end surface B110 of the fabric member 1061B at the contact surface 1071A which is a lower surface, and is connected to the wire spring 1080 at an upper surface.

The arm portion 1072 is formed to extend downward from each of both end portions in a front-back direction of the contact portion 1071 and is provided in a pair before and after the fabric member 1061B. A protrusion 1072A (an example of a pinch portion) which protrudes to the fabric member 1061B side, is formed at a lower end portion of the arm portion 1072. Here, the clip member 1070 performs pinching by the protrusion 1072A by bringing the end surface B110 of the fabric member 1061B into contact with the contact surface 1071A of the contact portion 1071 and then pushing the fabric member 1061B so as to be bent. Thus, the length from the end surface B110 on the contact portion 1071 side to a portion which is pinched by the protrusions 1072A becomes longer than the length from the contact surface 1071A of the contact portion 1071 to the protrusion 1072A. The configuration of the arm portion 1072 can be arbitrarily changed and may be, for example, a configuration in which the arm portion 1072 does not have the protrusion 1072A and the fabric member is pinched by the entire arm portion.

The wire spring 1080 is for connecting the clip member 1070 and the outer reinforcing plate 1032C, as shown in FIG. 11A, and has a connection portion 1081 and a joining portion 1082 connected to an upper end portion of the connection portion 1081.

The connection portion 1081 is a portion which is connected to the clip member 1070 and a lower end portion thereof is fixed to the clip member 1070 by welding or the like.

The joining portion 1082 is a portion which is connected to the outer reinforcing plate 1032C, and has a C-shaped hook shape. If the joining portion 1082 is hooked around the screw 1032E, the wire spring 1080 is connected to the outer reinforcing plate 1032C. In addition, a method of connecting the joining portion 1082 can be arbitrarily changed, and the joining portion 1082 may be directly fixed to the outer reinforcing plate 1032C by, for example, an adhesive or the like.

Accordingly, in this illustrative embodiment, the heat radiation member for radiating heat of the side seal member 1061 is configured by the layer thickness regulating blade 1032 described above, the outer reinforcing plate 1032C, the clip member 1070, and the wire spring 1080. The heat radiation member configured in this manner is made such that the outer reinforcing plate 1032C is exposed to the outside of the casing 1050, whereby heat transmitted from the fabric member 1061B to the clip member 1070 is radiated to the outside through the wire spring 1080, the layer thickness regulating blade 1032, and the outer reinforcing plate 1032C.

As shown in FIG. 11C, since the end surface B110 of the fabric member 1061B is in contact with the contact portion 1071 of the clip member 1070, heat generated at the sliding contact portion between the developing roller 1031 and the fabric member 1061B can be transmitted from the end surface of each longitudinal fiber B101 to the clip member 1070. Therefore, it becomes possible to radiate the transmitted heat through the wire spring 1080, the layer thickness regulating blade 1032, and the outer reinforcing plate 1032C. In addition, the clip member 1070 is also in contact with the planar surface of the fabric member 1061B (the circumferential surface of the longitudinal fiber B101) at the protrusion 1072A of the arm portion 1072, and thus heat is also radiated from here. However, since a heat radiation amount per unit area is larger at the end surface of a fiber than the circumferential surface of a fiber, heat radiation efficiency from the end surface of each longitudinal fiber B101 to the contact portion 1071 becomes larger.

In the above-described developing cartridge 1028, as shown in FIGS. 8 and 11, when the developing roller 1031 rotates, both end portions of the developing roller 1031 and the surfaces on the developing roller 1031 side of the fabric members 1061B come into sliding contact with each other. When heat is generated from the sliding contact portion between the developing roller 1031 and the fabric member 1061B, the heat is transmitted along each longitudinal fiber B101 and then efficiently transmitted from the end surface of each longitudinal fiber B101 to the contact portion 1071 of the clip member 1070.

Incidentally, the heat radiation member is not in contact with the end surface on the lower side of the longitudinal fiber B101. Specifically, since the end surface is in contact with air, a heat radiation amount from the end surface is small. Further, since the heat radiation member is also not in contact with the end surface of each lateral fiber B102 (the end surface is in contact with air), a heat radiation amount from the end surface is smaller and the heat of each lateral fiber B102 is transmitted to each longitudinal fiber B101 having a relatively low temperature.

Then, heat transmitted from the end surface of each longitudinal fiber B101 to the contact portion 1071 of the clip member 1070 is radiated to the outside of the casing 1050 through the wire spring 1080, the layer thickness regulating blade 1032, and the outer reinforcing plates 1032C. Therefore, according to this illustrative embodiment, it is possible to allow the heat generated at the sliding contact portion between the developing roller 1031 and the side seal member 1061 to escape through the heat radiation member (the clip member 1070 and the like).

Further, since the end surface of each longitudinal fiber B101 is brought into contact with the contact portion 1071 of the clip member 1070, compared to a structure of bringing a heat radiation member into contact with only the planar surface of the fabric member 1061B (the circumferential surface of the fiber), it is possible to allow heat transmitted to each longitudinal fiber B101 to efficiently escape to the clip member 1070 (the heat radiation member).

Further, since the outer reinforcing plate 1032C and the clip member 1070 are connected by the wire spring 1080, in a case where the side seal member 1061 is pulled when assembling the developing roller 1031, the wire spring 1080 is deformed, and thus the clip member 1070 and the side seal member 1061 (the fabric member 1061B) can be moved downward together. Therefore, separation of the end surface of each longitudinal fiber B101 from the contact portion 1071 of the clip member 1070 (the heat radiation member) can be suppressed.

Further, since the heat radiation member includes the clip member 1070, by pinching the fabric member 1061B by the protrusions 1072A of the clip member 1070, it is possible to maintain a contact state of the contact portion 1071 with the end surface B110 of the fabric member 1061B. For this reason, it is possible to fix the side seal member 1061 to the clip member 1070 with a simple configuration.

Further, since the length from the end surface B110 on the contact portion 1071 side of the fabric member 1061B to a portion which is pinched by the protrusions 1072A is longer than the length from the contact surface 1071A of the contact portion 1071 to the protrusion 1072A, it is possible to reliably bring the end surface of the longitudinal fiber B101 into contact with the contact portion 1071.

Further, since the clip member 1070 (the heat radiation member) is disposed at a position other than the portion facing the developing roller 1031 of the fabric member 1061B, compared to a configuration in which a heat radiation member is disposed at a portion facing the developing roller 1031, it is possible to suppress the contact of the developing roller 1031 with the heat radiation member.

The fifth illustrative embodiment of the present invention has been described above. However, the present invention is not limited to the above-described illustrative embodiment. With respect to the specific configuration, a change can be appropriately made within a scope which does not depart from the gist of the present invention. In the following description, approximately the same configurations as those in the above-described illustrative embodiment are denoted by the same reference numerals as those in the illustrative embodiment and description thereof is omitted.

Sixth Illustrative Embodiment

Figure 12A:
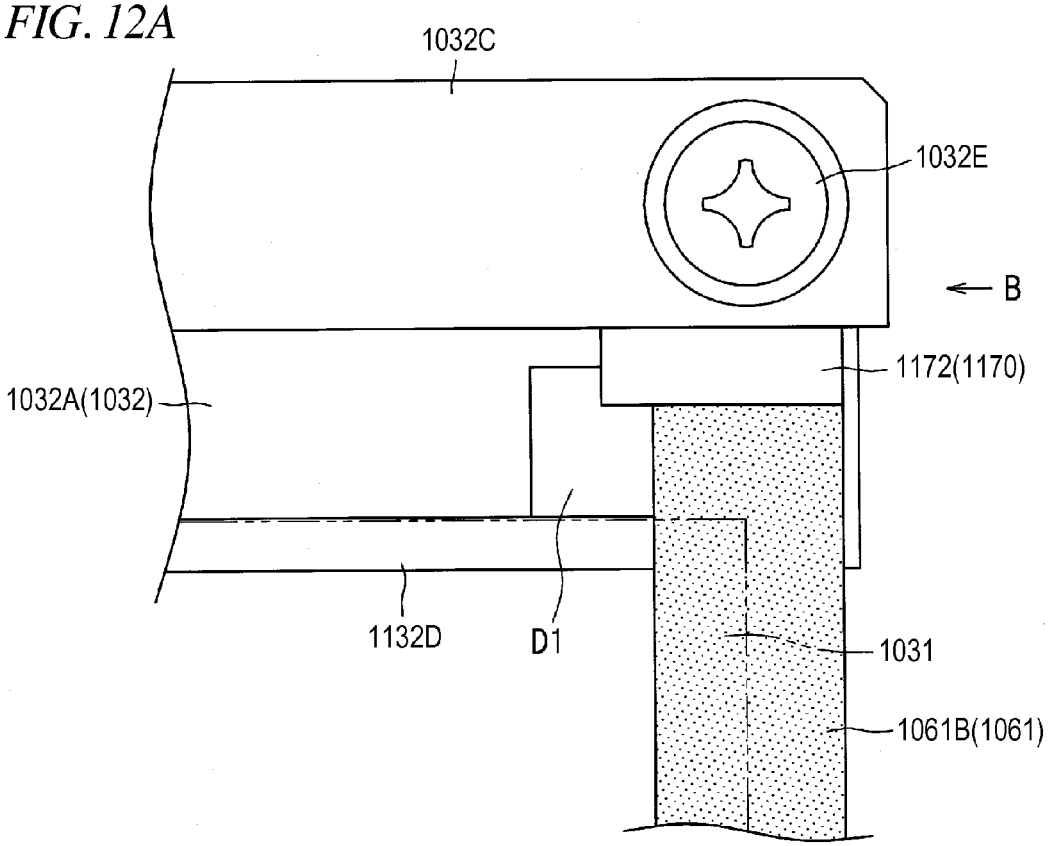
FIG. 12A is a diagram equivalent to FIG. 11A in a sixth illustrative embodiment.
Figure 12B:
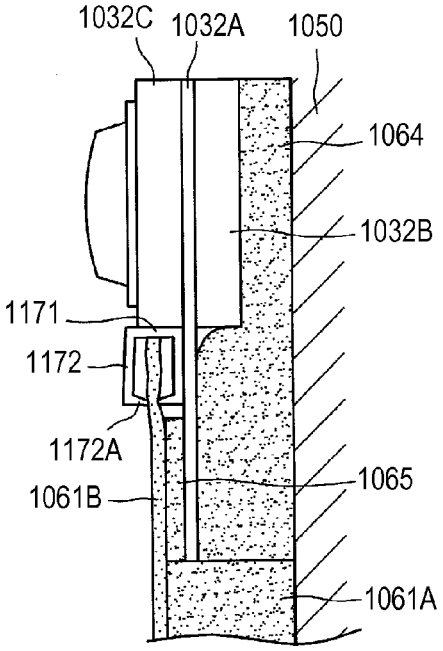
FIG. 12B is a view when

In the fifth illustrative embodiment, the clip member 1070 is connected to the outer reinforcing plate 1032C by the wire spring 1080. However, the present invention is not limited thereto, and as shown in, for example, FIGS. 12A and 12B, a configuration may also be made such that a clip member 1170 is disposed to be fitted between a pressing member 1132D (an example of a contact portion) and the outer reinforcing plate 1032C (an example of a holding member) and comes into contact with the outer reinforcing plate 1032C.

The pressing member 1132D in this configuration has a positioning portion D1 for fitting the clip member 1170 between itself and the outer reinforcing plate 1032C.

The positioning portions D1 are respectively disposed at both end portions in the left-right direction of the pressing member 1132D and extend toward the outer reinforcing plate 1032C side from both end portions of the pressing member 1132D. In the positioning portion D1, an edge on the outside in the left-right direction in an upper end portion thereof is cut out into a substantially L-shape.

The clip member 1170 is configured to have a contact portion 1171 and an arm portion 1172 having a protrusion 1172A (an example of a pinch portion), similar to the fifth illustrative embodiment, and is made such that the length thereof in the left-right direction is longer than the length in the left-right direction of the side seal member 1061. An end portion on the inside in the left-right direction of the clip member 1170 is fitted between the cutout portion of the positioning portion D1 and the outer reinforcing plate 1032C, whereby the clip member 1170 is positioned and comes into contact with the outer reinforcing plate 1032C.

In this illustrative embodiment, the heat radiation member for radiating heat of the side seal member 1061 is configured by the layer thickness regulating blade 1032, the outer reinforcing plate 1032C, and the clip member 1170.

Even in such a configuration, since the end surfaces of the fibers of the fabric member 1061B are in contact with the clip member 1170 (the heat radiation member), it is possible to allow the heat generated at the sliding contact portion between the developing roller 1031 and the side seal member 1061 to escape through the heat radiation member.

In the developing cartridge configured as described above, as shown in FIGS. 12A and 12B, similar to the fifth illustrative embodiment, in a case where heat is generated from the sliding contact portion between the developing roller 1031 and the fabric member 1061B, the heat is transmitted along each longitudinal fiber B101 and then efficiently transmitted from the end surface of each longitudinal fiber B101 to the contact portion 1171 of the clip member 1170.

Then, the heat transmitted from the end surface of each longitudinal fiber B101 to the contact portion 1171 of the clip member 1170 is radiated to the outside of the casing 1050 through the layer thickness regulating blade 1032 and the outer reinforcing plate 1032C. Therefore, according to this illustrative embodiment, it is possible to allow the heat generated at the sliding contact portion between the developing roller 1031 and the side seal member 1061 to escape through the heat radiation member (the clip member 1170 and the like).

Further, since the clip member 1170 is disposed to be fitted between the positioning portion D1 of the pressing member 1132D and the outer reinforcing plate 1032C, in a case where the side seal member 161 is pulled when assembling the developing roller 1031, the positioning portion D1 (the pressing member 1132D) is elastically deformed, and thus the clip member 1170 and the side seal member 1061 (the fabric member 1061B) can be moved together. Therefore, separation of the end surface of the longitudinal fiber B101 from the contact portion 1171 (the heat radiation member) of the clip member 1170 can be suppressed.

Seventh Illustrative Embodiment

Figure 13A:
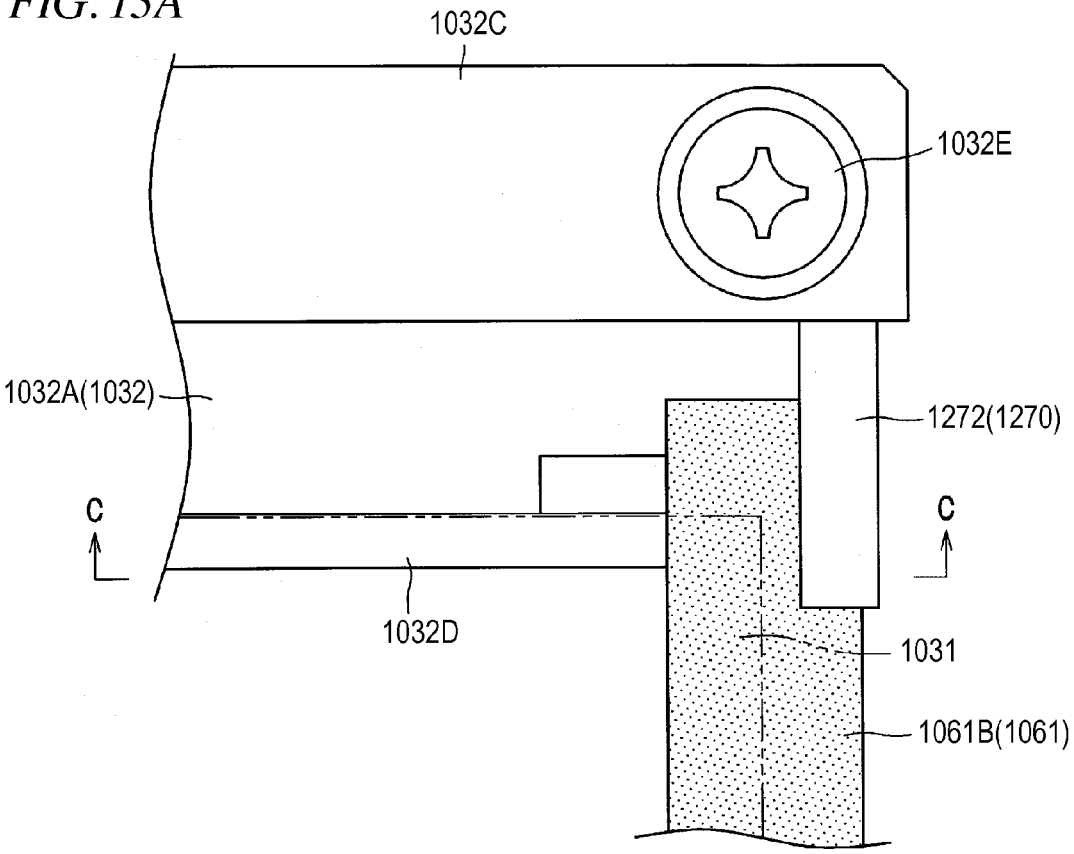
FIG. 13A is a diagram equivalent to FIG. 11A in a seventh illustrative embodiment.
Figure 13B:
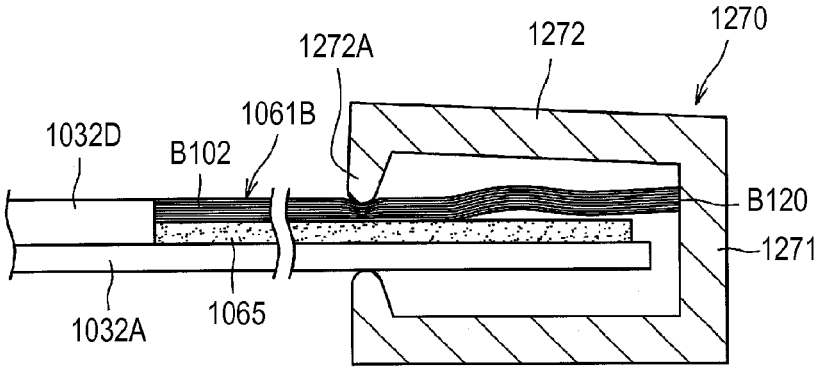
FIG. 13B is a cross-sectional view taken along line C-C of FIG. 13A.

In the fifth illustrative embodiment, a configuration of brining the end surfaces of the longitudinal fibers B101 into contact with the heat radiation member is illustrated. However, as shown in, for example, FIGS. 13A and 13B, a configuration of bringing the end surfaces of the lateral fibers B102 into contact with the heat radiation member may be also employed.

A clip member 1270 is configured to have a contact portion 1271 and an arm portion 1272 having a protrusion 1272A (an example of a pinch portion), similar to the illustrative embodiments described above. The clip member 1270 is disposed so as to sandwich the fabric member 1061B, the intermediate member 1065, and the metal plate 1032A from the outside in the left-right direction of the developing roller 1031 by the arm portion 1272, whereby the contact portion 1271 comes into contact with an end surface B120 of each lateral fiber B102. Further, the clip member 1270 is disposed so as not to come into contact with the developing roller 1031 such that a position to pinch the fabric member 1061B and the like, that is, the position of the protrusion 1272A is on the outside in the left-right direction of the developing roller 1031. The clip member 1270 is in contact with the outer reinforcing plate 1032C at an upper end portion.

Then, in this illustrative embodiment, the heat radiation member for radiating heat of the side seal member 1061 is configured by the layer thickness regulating blade 1032, the outer reinforcing plate 1032C, and the clip member 1270.

Even in such a configuration, since the end surfaces B120 of the lateral fibers B102 are in contact with the clip member 1270, it is possible to allow the heat generated at the sliding contact portion between the developing roller 1031 and the side seal member 1061 to escape through the heat radiation member.

In the developing cartridge configured as described above, as shown in FIGS. 13A and 13B, in a case where heat is generated from the sliding contact portion between the developing roller 1031 and the fabric member 1061B, the heat is transmitted along each lateral fiber B102 and then efficiently transmitted from the end surface B120 of each lateral fiber B102 to the contact portion 1271 of the clip member 1270.

Then, the heat transmitted from the end surface B120 of each lateral fiber B102 to the contact portion 1271 of the clip member 1270 is radiated to the outside of the casing 1050 through the layer thickness regulating blade 1032 and the outer reinforcing plate 1032C. Therefore, according to this illustrative embodiment, it is possible to allow the heat generated at the sliding contact portion between the developing roller 1031 and the side seal member 1061 to escape through the heat radiation member (the clip member 1270 and the like).

Further, since the clip member 1270 is disposed so as to sandwich the layer thickness regulating blade 1032 and the fabric member 1061B from the outside in the left-right direction of the developing roller 1031, the end surface B120 on the outside in the left-right direction of the lateral fiber B102 and the contact portion 1271 of the clip member 1270 come into contact with each other. Therefore, even if when assembling the developing roller 1031, the side seal member 1061 is pulled downward and thus the side seal member 1061 moves with respect to the clip member 1270, separation of the end surface B120 of the lateral fiber B102 from the contact portion 1271 (the heat radiation member) of the clip member 1270 can be suppressed as long as the side seal member 1061 is sandwiched in the clip member 1270.

Eighth Illustrative Embodiment

Figure 14A:
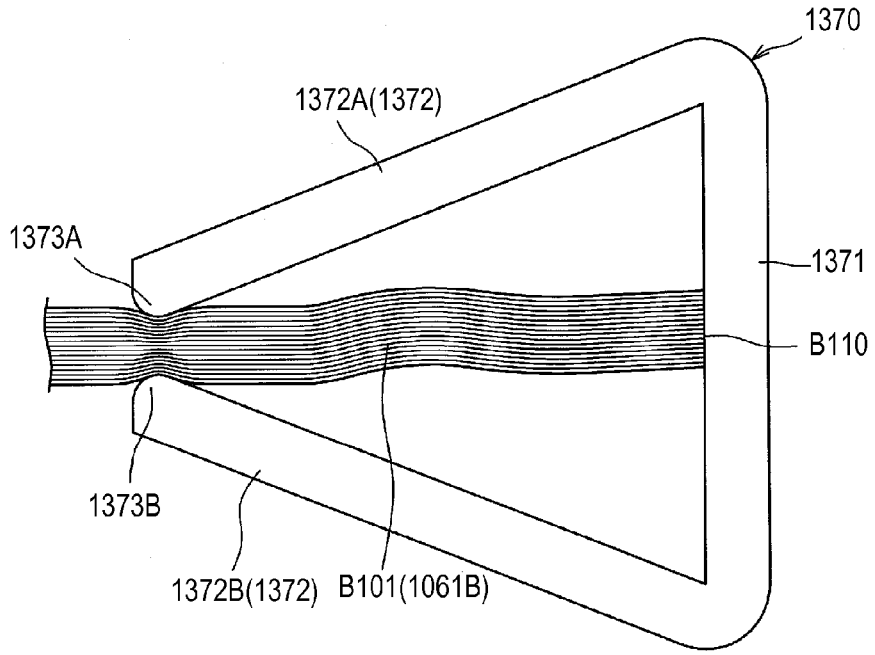
FIG. 14A is an enlarged view of a clip member in an eighth illustrative embodiment.

In the fifth illustrative embodiment, a configuration is illustrated in which the clip member 1070 elastically pinches the fabric member 1061B. However, as shown in FIG. 14A, a configuration may also be made such that a clip member 1370 pinches the fabric member 1061B in a state of being plastically deformed.

The clip member 1370 in this configuration is a plastically-deformable member and is configured to have a contact portion 1371 extending in the vertical direction in the drawing and arm portions 1372 which are connected to both end portions in the vertical direction in the drawing of the contact portion 1371.

The arm portion 1372 is formed such that an upper arm portion 1372A extends obliquely left downward in the drawing from an upper end portion of the contact portion 1371 and a lower arm portion 1372B extends obliquely left upward in the drawing from a lower end portion of the contact portion 1371. By pinching the fabric member 1061B by tip portions 1373A and 1373B of the arm portions 1372A and 1372B and bringing the end surface B110 of each longitudinal fiber B101 into contact with the contact portion 1371, it is possible to allow heat generated at the sliding contact portion between the developing roller 1031 and the side seal member 1061 to escape through the clip member 1370 (the heat radiation member), similar to the illustrative embodiments described above. Each of the tip portions 1373A and 1373B of the arm portions 1372A and 1372B is an example of a pinch portion.

Ninth Illustrative Embodiment

Figure 14B:
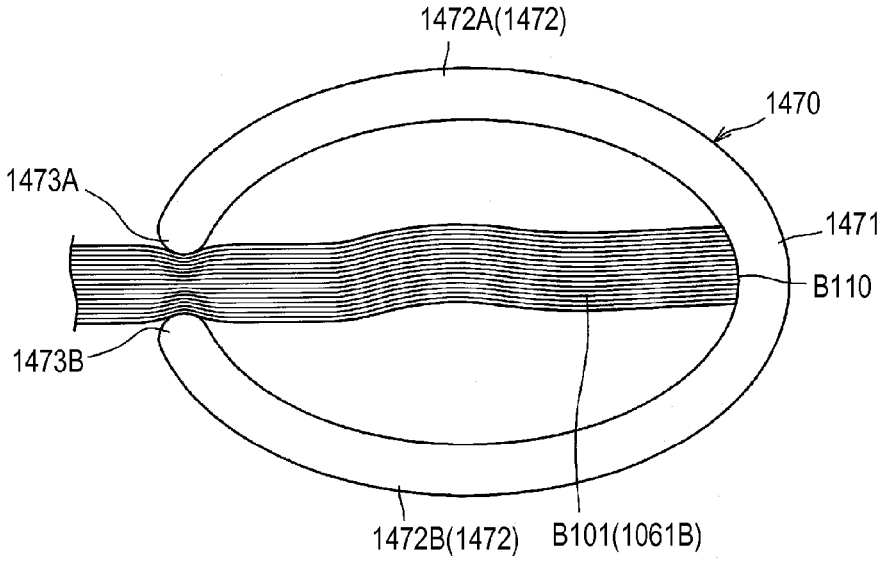
FIG. 14B is an enlarged view of a clip member in a ninth illustrative embodiment.

Further, a configuration having a clip member 1470 as shown in FIG. 14B may be also employed.

The clip member 1470 in this configuration is a plastically-deformable member and is formed into a substantially C-shape opened in the left direction in the drawing. The clip member 1470 can pinch the fabric member 1061B by a tip portion 1473A of an upper arm portion 1472A and a tip portion 1473B of a lower arm portion 1472B. By bringing the end surface B110 of each longitudinal fiber B101 into contact with a contact portion 1471 which is a base end portion of each of the arm portions 1472A and 1472B in this way, it is possible to allow heat generated at the sliding contact portion between the developing roller 1031 and the side seal member 1061 to escape through the clip member 1470 (the heat radiation member), similar to the illustrative embodiments described above. Each of the tip portions 1473A and 1473B of the arm portions 1472A and 1472B is an example of a pinch portion.

In the fifth to ninth illustrative embodiments described above, the fabric member 1061B is made such that the length from the end surface B110 on the contact portion 1071 side of the clip member 1070 to a portion which is pinched by the protrusion 1072A (the pinch portion) is longer than the length from the contact portion 1071 to the protrusion 1072A. However, the present invention is not limited thereto. For example, as long as the end surface of a fabric member is in contact with a contact portion of a clip member, the length from an end surface on the contact portion side to a portion which is pinched by the pinch portion may be the same as the length from the contact portion to the pinch portion.

In the fifth to ninth illustrative embodiments described above, the side seal member 1061 is fixed by the clip member 1070. However, the present invention is not limited thereto and a configuration may be also employed in which the circumferential surface of the longitudinal fiber B101 is fixed to the heat radiation member by, for example, an adhesive or the like and the end surface of the longitudinal fiber B101 is brought into contact with the heat radiation member.

In the fifth to ninth illustrative embodiments described above, the developing cartridge 1028 integrally having the toner accommodation chamber 1034 is illustrated as the developing device. However, the present invention is not limited thereto and the developing device may be, for example, a so-called process cartridge including a developing unit or a photosensitive drum on which a toner cartridge having a toner accommodation chamber is removably mounted, and a developing roller.

In the fifth to ninth illustrative embodiments described above, the laser printer is illustrated as an image forming apparatus on which the developing device is mounted. However, the present invention is not limited thereto and other image forming apparatuses such as a color printer or a multifunction machine, for example, may be also employed.

In the fifth to ninth illustrative embodiments described above, the side seal member 1061 has a two-layer structure. However, the present invention is not limited thereto and a three or more layered structure may be also employed as long as it has a fabric member. Further, the seal member is not limited to the side seal member 1061 as long as it is a seal member which comes into sliding contact with a developing roller, and, for example, in a case where a seal member is provided in place of the lower film 1063, the present invention may be applied to the seal member.

In the fifth to ninth illustrative embodiments described above, all of the respective members configuring the heat radiation member are formed of metal. However, the present invention is not limited thereto and the members may be formed of, for example, thermally-conductive resin.

Tenth Illustrative Embodiment

Next, a tenth illustrative embodiment of the present invention will be described. The overall configuration of the laser printer is approximately the same configuration as that in the first illustrative embodiment, and thus configurations in this illustrative embodiment are denoted by the same reference numerals as those in the first illustrative embodiment and description thereof is omitted. However, further detailed description will be provided to the configuration of a part of the laser printer.

Figure 15:
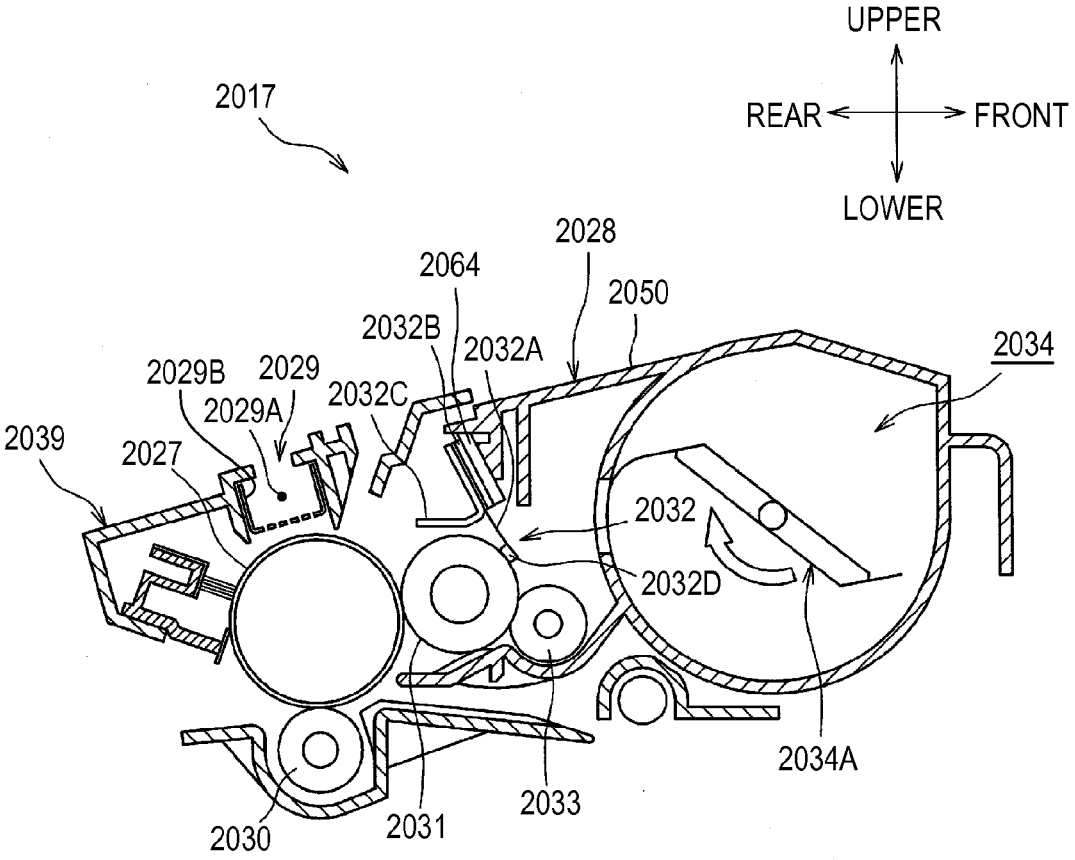
FIG. 15 is a cross-sectional view showing a developing cartridge according to a tenth illustrative embodiment.

As shown in FIG. 15, the scorotron type charger 2029 includes a charging wire 2029A which generates corona discharge, and a grid electrode 2029B (an example of a heat radiation member) which is disposed between the charging wire 2029A and the photosensitive drum 2027. The grid electrode 2029B is a member made of metal and is formed into a U-shape in a cross-sectional view, which is opened upward. A plurality of slits is formed at a lower wall portion of the grid electrode 2029B.

A fan (not shown) is provided in the main body casing 2, and the fan is driven, whereby air passes through the vicinity of the scorotron type charger 2029. Accordingly, due to air, sticking of foreign matter to the charging wire 2029A is suppressed and the grid electrode 2029B is cooled.

Detailed Structure of Developing Cartridge

The detailed structure of the developing cartridge 2028 will be described. Since the developing cartridge 2028 has a bilaterally symmetric structure, in FIG. 16 and the like, only a portion on one side of the left and the right is shown and illustration of a portion on the other side is omitted. Further, FIG. 16 shows a state where the developing roller 2031, the supply roller 2033, and the outer reinforcing plate 2032C (refer to FIG. 15) (described later) are removed.

Figure 16:
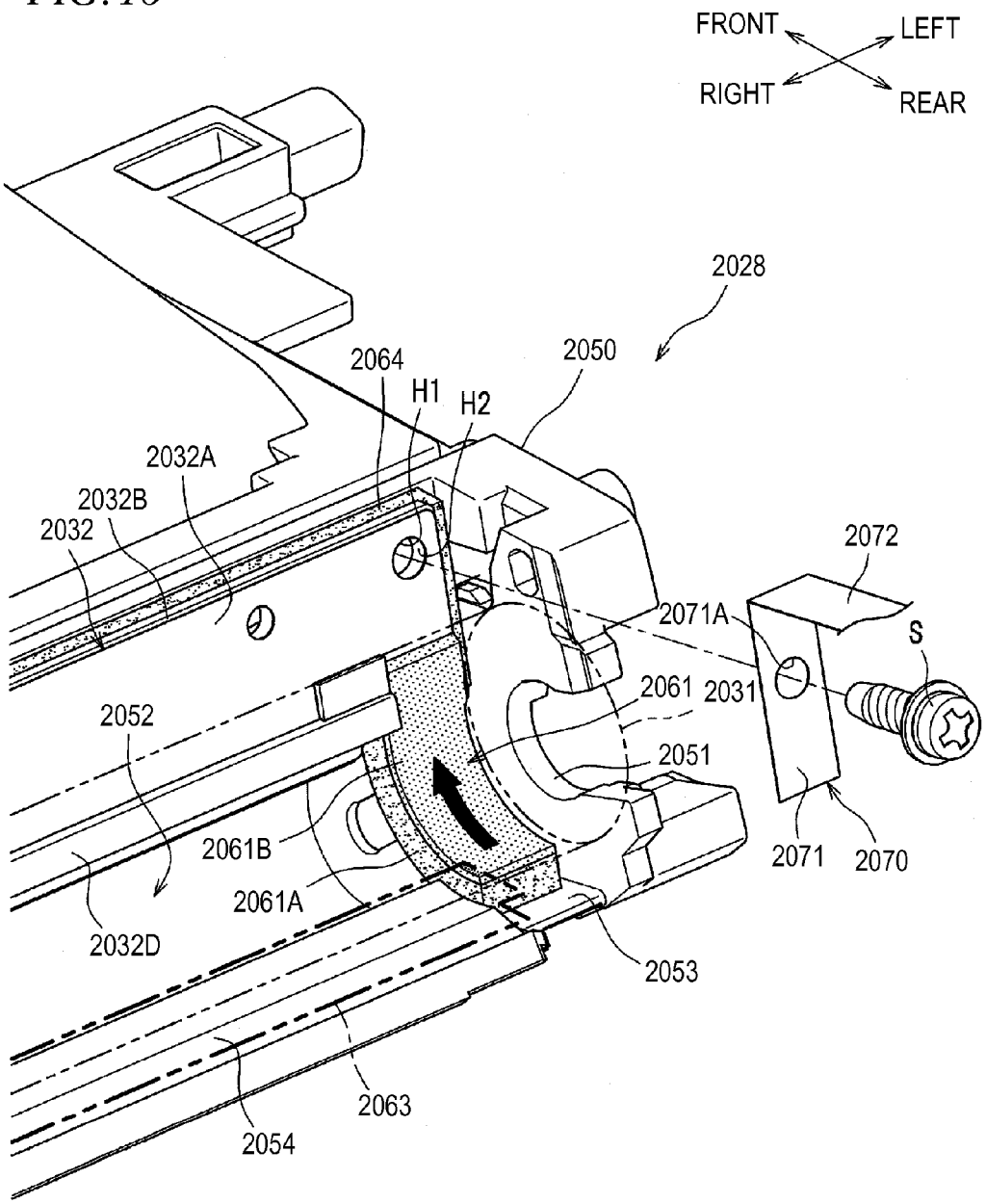
FIG. 16 is a perspective view showing a structure around an opening of a casing.

As shown in FIG. 16, the developing cartridge 2028 includes a casing 2050 for accommodating toner, a side seal member 2061 (an example of a seal member) which comes into sliding contact with each of both end portions of the developing roller 31, a lower film 63, and the like, in addition to the developing roller 2031 described above. The developing roller 2031 rotates in a direction of an arrow shown in the drawing, that is, rotates so as to come into sliding contact with the lower film 2063 and the side seal member 2061 in this order.

The casing 2050 includes a bearing section 2051 which rotatably supports the developing roller 2031, the opening 2052 for supplying toner from the toner accommodation chamber 2034 on the inside to the developing roller 2031, the side seal sticking surface 2053 to which the side seal member 2061 is stuck, and the supporting section 2054 which supports the lower film 2063 are formed therein. The opening 2052 is formed into the form of a rectangular long hole along the axial direction of the developing roller 2031, and the layer thickness regulating blade 2032 is fixed to an upper portion thereof.

The layer thickness regulating blade 2032 has the plate-shaped metal plate 2032A which is long in the left-right direction, and the pressing member 2032D which is made of rubber and is fixed to the lower end portion (the tip end portion) of the metal plate 2032A to come into contact with the developing roller 2031. The pressing member 2032D is formed such that the left-right width thereof is smaller than that of the metal plate 2032A. Further, both end portions in the left-right direction of the pressing member 2032D are in contact with the fabric members 2061B, as shown in FIG. 16.

Then, the fabric member 2061B (described later) is provided below each of the left and right end portions of the metal plate 2032A, specifically, outside in the left-right direction the pressing member 2032D, and a first heat transfer plate 2070 (an example of a heat transfer member) which comes into contact with the fabric member 2061B is provided on the upper side. The length in the left-right direction of the first heat transfer plate 2070 is approximately the same as to the length in the left-right direction of the fabric member 2061B. The first heat transfer plate 2070 is configured by bending into an L-shape a elastically-deformable metallic plate-shaped member and mainly has a first plate-shaped portion 2071 extending in the vertical direction and a second plate-shaped portion 2072 extending backward (to the drum unit 2039 side) from an upper end of the first plate-shaped portion 2071.

An insertion hole 2071A into which a screw S is inserted is formed at an upper portion of the first plate-shaped portion 2071. The second plate-shaped portion 2072 is configured so as to extend to a second heat transfer plate 2090 (described later) (refer to FIG. 18) and come into contact with the second heat transfer plate 2090. In each drawing, the first heat transfer plate 2070 is exaggeratingly depicted, and in fact, the first heat transfer plate 2070 is formed in the length of an extent that does not come into contact with the developing roller 2031.

Figure 18:
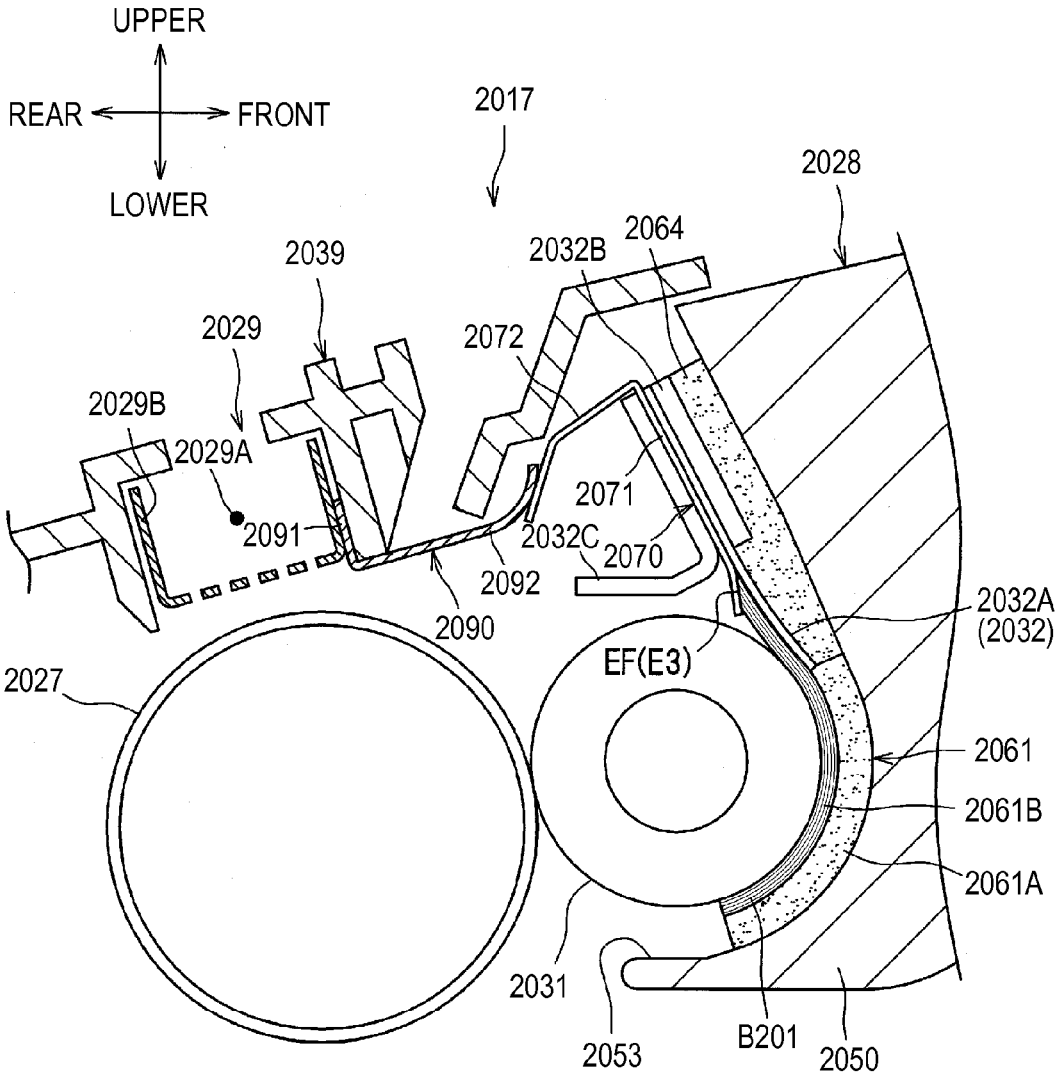
FIG. 18 is a cross-sectional view showing a structure for transferring heat from a fabric member to a grid electrode.

As shown in FIG. 18, an upper portion of the first plate-shaped portion 2071 is sandwiched and held by the pair of metallic reinforcing plates 2032B and 2032C along with an upper portion of the layer thickness regulating blade 2032. In FIG. 18, in consideration of the visibility of the drawing, hatching is appropriately omitted.

Then, the pair of reinforcing plates 2032B and 2032C which holds the layer thickness regulating blade 2032 and the first plate-shaped portion 2071 is fixed to the casing 2050 through a known blade back seal 2064. In other words, each component is fixed to the casing 2050 by screwing the screw S (refer to FIG. 16) in the casing 2050 through a though-hole (not shown) formed in the outer reinforcing plate 2032C, the insertion hole 2071A of the first plate-shaped portion 2071, though-holes H1 and H2 formed in the metal plate 2032A and the inner reinforcing plate 2032B, and a though-hole (not shown) formed in the blade back seal 2064. Then, due to such fixation, the upper portion of the first plate-shaped portion 2071 is sandwiched and held between the outer reinforcing plate 2032C and the layer thickness regulating blade 2032.

Further, in a state where the upper portion of the first plate-shaped portion 2071 is held by the reinforcing plate 2032C described above and the layer thickness regulating blade 2032 in this manner, a lower portion of the first plate-shaped portion 2071 sandwiches and holds an end surface EF of the fabric member 2061B (an inclined end surface F3 of each longitudinal fiber B201, which will be described later) between itself and a lower portion of the layer thickness regulating blade 2032. Specifically, the lower portion of the first plate-shaped portion 2071 is bent toward the developing roller 2031 side, thereby biasing the end surface EF of the fabric member 2061B toward the layer thickness regulating blade 2032, and therefore, since the lower portion of the first plate-shaped portion 2071 is strongly pressed against the end surface EF of the fabric member 2061B, it becomes possible to favorably bring the first plate-shaped portion 2071 and the end surface EF of the fabric member 2061B (the inclined end surface F3 of each longitudinal fiber B201) into contact with each other.

As shown in FIG. 16, the side seal sticking surface 2053 is a surface having a substantially arcuate shape in a cross-sectional view and is formed on each of both left and right sides of the opening 2052 (on the outside in the axial direction of the developing roller 2031). The side seal member 2061 is provided on the side seal sticking surface 2053. The side seal member 61 will be described in detail later.

The supporting section 2054 is formed so as to protrude further to the developing roller 2031 side than the side seal sticking surface 2053 and extend along the axial direction of the developing roller 2031. The lower film 2063 is provided on the upper surface of the supporting section 2054.

The lower film 2063 is a sheet-like member made of resin such as polyethylene terephthalate and extends along the axial direction of the developing roller 2031 to come into sliding contact with approximately the entirety of the developing roller 2031. Then, the lower film 2063 is formed longer in the left-right direction than the supporting section 2054 and disposed such that in a state where the lower film 2063 is stuck to the supporting section 2054, both end portions thereof protrude from the supporting section 2054, thereby overlapping the side seal members 2061. Accordingly, it becomes possible to favorably suppress toner leakage between the side seal member 2061 and the lower film 2063.

Figure 17A:
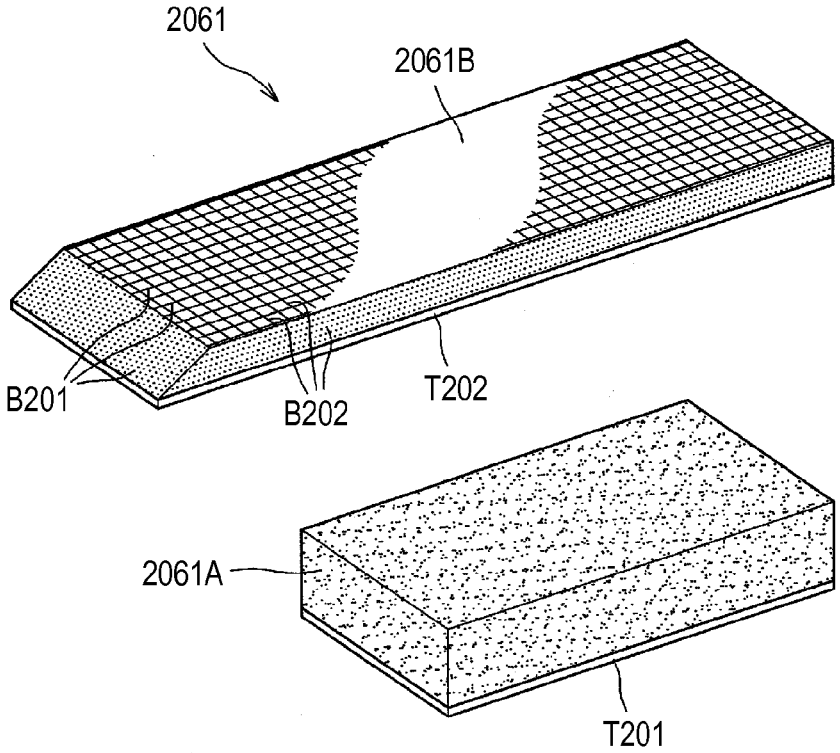
FIG. 17A is an exploded perspective view showing a side seal member in a simplified manner.

The side seal member 2061 is a member for suppressing toner leakage from the gap between each of both end portions of the developing roller 2031 which is disposed so as to face the opening 2052 of the casing 2050 and the side seal sticking surface 2053, and is provided between each of both end portions of the developing roller 2031 and the side seal sticking surface 2053. As shown in FIGS. 17 and 18, the side seal member 2061 includes the base material 2061A having elasticity and the fabric member 2061B which is laminated on the surface on the developing roller 2031 side of the base material 2061A.

The base material 2061A is formed of an elastic body such as an elastically-deformable urethane sponge and is stuck to the side seal sticking surface 2053 of the casing 2050 by the double-sided tape T201 so as to be adjacent to the lower end of the blade back seal 2064. In FIG. 18, for convenience, illustration of the double-sided tapes T201 and T202 is omitted.

The fabric member 2061B is formed into a long sheet shape extending along the rotation direction of the developing roller 2031 and is formed so as to be longer than the base material 2061A in the longitudinal direction. Then, the fabric member 2061B is stuck to the base material 2061A and the metal plate 2032A of the layer thickness regulating blade 2032 by the double-sided tape T202, whereby the end surface EF on the upper side thereof is in contact with the first heat transfer plate 2070 described above.

Specifically, the fabric member 61B is configured by interweaving a plurality of longitudinal fibers B201 extending in the longitudinal direction (the rotation direction of the developing roller 2031) as an example of a first direction and a plurality of lateral fibers B202 extending in the short side direction (the axial direction of the developing roller 31) as an example of a second direction so as to intersect each other. Further, with respect to the diameter of each of the fibers B201 and B202 of the fabric member 2061B, the diameter of the longitudinal fiber B201 is about 150 μm and the diameter of the lateral fiber B202 is about 200 μm. Further, with respect to the weave, twill weave or satin weave may be preferable.

Specifically, the longitudinal fiber B201 is provided in plural in the short side direction of the fabric member 2061B and also provided in plural in the thickness direction of the fabric member 2061B. Further, the lateral fiber B202 is provided in plural in the longitudinal direction of the fabric member 2061B and also provided in plural in the thickness direction of the fabric member 2061B. For example, in FIG. 16 and the like, each of the fibers B201 and B202 is appropriately omitted in consideration of the visibility of the drawing.

Figure 17B:
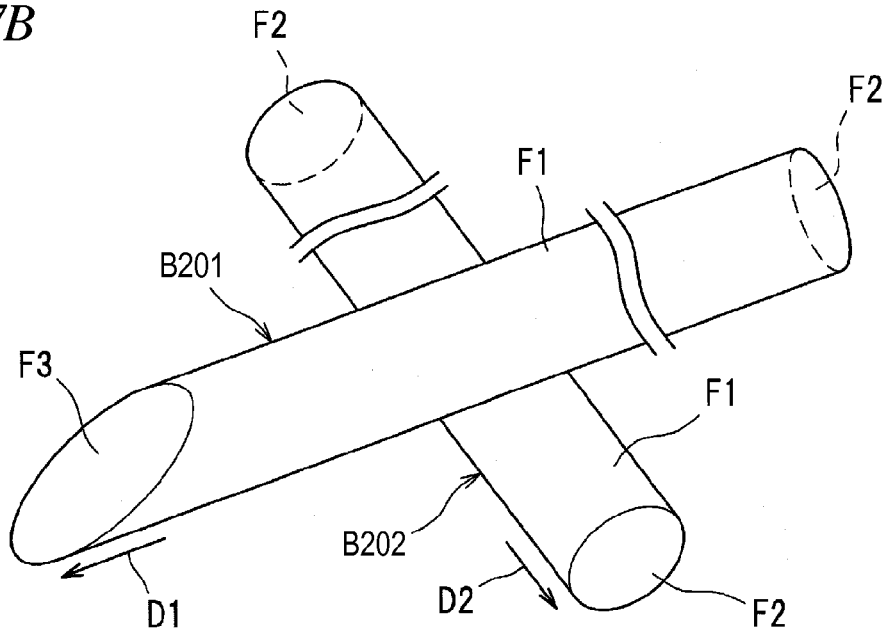
FIG. 17B is an enlarged perspective view showing end surfaces of fibers.

As shown in FIG. 17B, each of the fibers B201 and B202 has a circumferential surface F1 in which a heat radiation amount per unit area is the first heat radiation amount, and end surfaces F2 and F3 in which a heat radiation amount per unit area is the second heat radiation amount larger than the first heat radiation amount. Specifically, as each of the fibers B201 and B202 having such properties, it is possible to adopt a fiber having a molecular structure in which molecules are arranged linearly, and it is possible to adopt, for example, an ultrahigh molecular weight polyethylene or PBO (polyparaphenylenebenzobisoxazole) fiber or the like. In addition, specifically, a fiber may be preferable in which thermal conductivity (at 100K) in a direction toward the end surface is equal to or greater than 0.1 W/cm·K and equal to or less than 1.0 W/cm~K and is equal to or greater than two to 50 times of the thermal conductivity in a circumferential surface direction. In this illustrative embodiment, the Dyneema (registered trademark) SK60 fiber manufactured by Toyobo Co., Ltd. is used.

The end surface F3 on the first heat transfer plate 2070 side of a pair of end surfaces F2 and F3 of the longitudinal fiber B201 is formed as an inclined surface which is inclined with respect to an extension direction (hereinafter also referred to as an extension direction D1) of the longitudinal fiber B201. Specifically, as shown in FIG. 18, the end surface EF on the upper side of the fabric member 2061B (the end surface F3 on the upper side of each longitudinal fiber B201) is inclined along the surface of the first heat transfer plate 2070 in a bent state and is in contact with the first heat transfer plate 2070 in a state of facing the first heat transfer plate 2070.

By bringing the inclined end surface F3 of the longitudinal fiber B201 into contact with the first heat transfer plate 2070 in this manner, compared to, for example, a structure in which a heat radiation plate is brought into contact with a circumferential surface of a longitudinal fiber, it becomes possible to efficiently propagate heat generated at the sliding contact portion between the developing roller 2031 and the fabric member 2061B along the extension direction (a direction in which molecules are arranged) of each longitudinal fiber B201 and then allow the heat to escape to the first heat transfer plate 2070. Incidentally, it is confirmed by experiments by the inventors of this present invention that a heat radiation effect becomes larger in a case of bringing a heat radiation member into contact with an end surface of a fiber than a case of bringing a heat radiation member into contact with a circumferential surface of a fiber.

Further, the end surface F3 which comes into contact with the first heat transfer plate 2070, of the longitudinal fiber B201, is an inclined surface, whereby the area of the end surface F3 of the longitudinal fiber B201 can be increased compared to, for example, a case where an end surface of a longitudinal fiber is a surface orthogonal to an extension direction of the longitudinal fiber, and therefore, the contact area between the end surface F3 of the longitudinal fiber B201 and the first heat transfer plate 2070 increases, and thus it becomes possible to favorably perform heat radiation.

Further, as shown in FIG. 17B, the end surface F2 on the opposite side to the inclined end surface F3 of the longitudinal fiber B201 is formed as a surface orthogonal to the extension direction D1. Further, all of a pair of end surfaces F2 of the lateral fiber B202 is formed as a surface orthogonal to an extension direction (hereinafter also referred to as an extension direction D2) of the lateral fiber B202.

The end surfaces F2 and F3 of each of the fibers B201 and B202 are formed in this manner, whereby in a state where the side seal member 2061 is stuck to the casing 2050, as shown in FIG. 16, the end surface F2 on the inside in the left-right direction of the lateral fiber B202, that is, the end surface F2 on the opening 2052 side becomes a surface orthogonal to the extension direction D2. Therefore, since the area of the end surface F2 on the opening 2052 side of the lateral fiber B202 becomes smaller than that of the inclined end surface F3, it becomes possible to suppress transmission of heat of the lateral fiber B202 from the end surface F2 on the opening 2052 side to the toner in the casing 2050.

As shown in FIG. 18, the second heat transfer plate 2090 (an example of a heat transfer member) which comes into contact with the first heat transfer plate 2070 and the grid electrode 2029B and transmits heat of the first heat transfer plate 2070 to the grid electrode 2029B is provided in the drum unit 2039. The second heat transfer plate 2090 is configured by bending into an L-shape an elastically-deformable metallic plate-shaped member and is mainly provided with a first extension portion 2091 extending in the vertical direction and a second extension portion 2092 extending forward (to the developing cartridge 2028 side) from a lower end of the first extension portion 9120. Then, an upper end portion of the first extension portion 2091 is fixed to a side wall of the grid electrode 2029B such that the upper end portion of the first extension portion 2091 comes into contact with the side wall of the grid electrode 2029B. Further, when the developing cartridge 2028 is mounted on the drum unit 2039, a front end portion of the second extension portion 2092 comes into contact with a rear end portion of the second plate-shaped portion 2072 of the first heat transfer plate 2070.

Accordingly, since the grid electrode 2029B is indirectly connected to (brought into contact with) the end surface EF of the fabric member 2061B (the inclined end surface F3 of each longitudinal fiber B201) through the first heat transfer plate 2070 and the second heat transfer plate 2090, heat from the end surface EF is transmitted to the grid electrode 2029B through the first heat transfer plate 2070 and the second heat transfer plate 2090 and radiated from the grid electrode 2029B.

Action of radiating heat generated from the sliding contact portion between the developing roller 2031 and the side seal member 2061 will be described in detail.

As shown in FIGS. 16 and 18, when the developing roller 2031 rotates, both end portions of the developing roller 2031 and the surfaces on the developing roller 2031 side of the fabric members 2061B come into sliding contact with each other. Then, in a case where heat is generated from the sliding contact portion between the developing roller 2031 and the fabric member 2061B, the heat is transmitted along each longitudinal fiber B201 and then efficiently transmitted from the inclined end surface F3 on the upper side of each longitudinal fiber B201 to the first heat transfer plate 270.

In addition, since the first heat transfer plate 2070 is not in contact with the end surface F2 on the lower side of the longitudinal fiber B201, and specifically, the end surface F2 is in contact with air, a heat radiation amount from the end surface F2 is smaller. Further, since the first heat transfer plate 2070 is also not in contact with the end surface F2 of each lateral fiber B202 (the end surface F2 is in contact with air), a heat radiation amount from the end surface F2 is smaller and the heat of each lateral fiber B202 is transmitted to each longitudinal fiber B201 having a relatively low temperature.

Then, heat transmitted from the inclined end surface F3 of each longitudinal fiber B201 to the first heat transfer plate 2070 is radiated to the outside of the casing 2050 through the second heat transfer plate 2090 and the grid electrode 2029B. Therefore, according to this illustrative embodiment, it is possible to favorably radiate heat generated from the sliding contact portion between the developing roller 2031 and the side seal member 2061 to the outside.

As described above, according to this illustrative embodiment, in addition to the above described effects, the following effects can be obtained.

Due to a configuration in which the heat radiation member is provided in the drum unit 2039, it is possible to increase the degree of freedom of the layout of the heat radiation member, such as one capable of using the grid electrode 2029B as the heat radiation member, as in this illustrative embodiment. Further, the first heat transfer plate 2070 and the second heat transfer plate 2090 are provided between the grid electrode 2029B as the heat radiation member and the fabric member 2061B, whereby it is possible to set disposition of the grid electrode 2029B to a free position, and therefore, it is possible to dispose the grid electrode 229B at a proper position suitable for charging.

Further, the grid electrode 2029B which is cooled by air is used as the heat radiation member, whereby it is possible to favorably perform heat radiation from the fabric member 2061B.

Eleventh Illustrative Embodiment

Next, an eleventh illustrative embodiment of the present invention will be described in detail. Since this illustrative embodiment shows an example in which a heat radiation member or a heat transfer member different from that in the tenth illustrative embodiment is used, approximately the same constituent elements as those in the tenth illustrative embodiment are denoted by the same reference numerals as those in the tenth illustrative embodiment and description thereof is omitted.

Figure 19A:
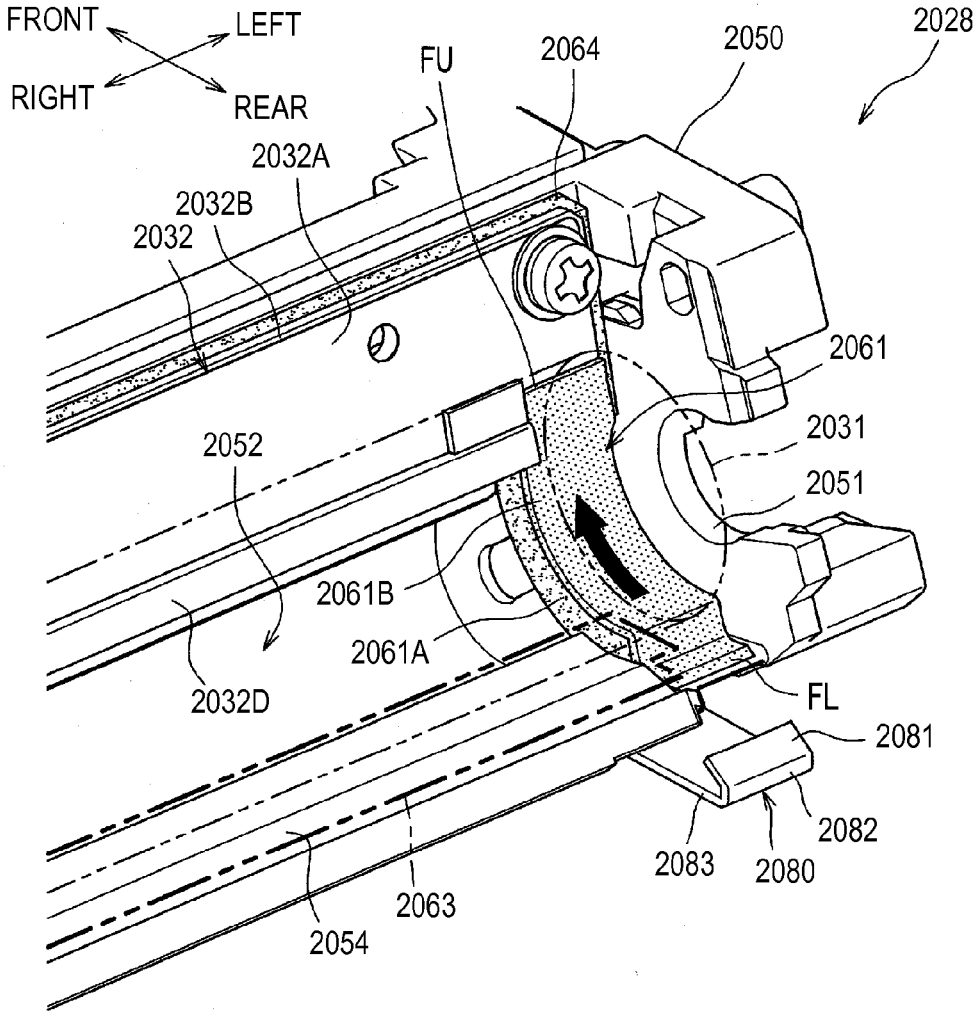
FIG. 19A is an exploded perspective view showing a state where a third heat transfer plate in an eleventh illustrative embodiment is taken off from a casing.
Figure 19B:
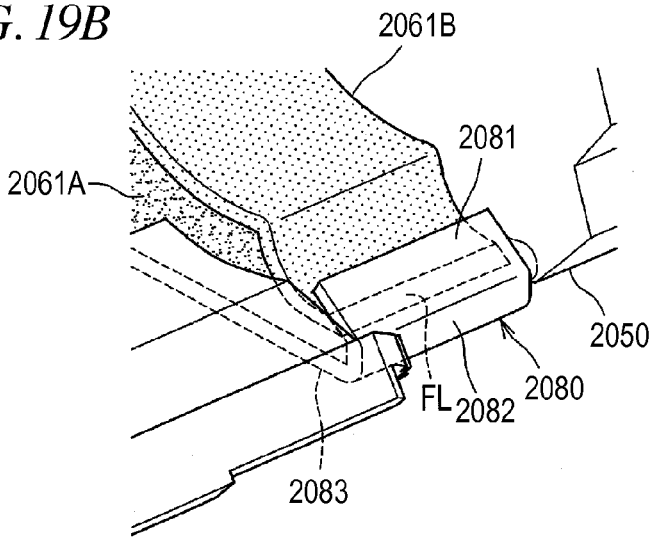
FIG. 19B is a perspective view showing a state where the third heat transfer plate is mounted.
Figure 20:
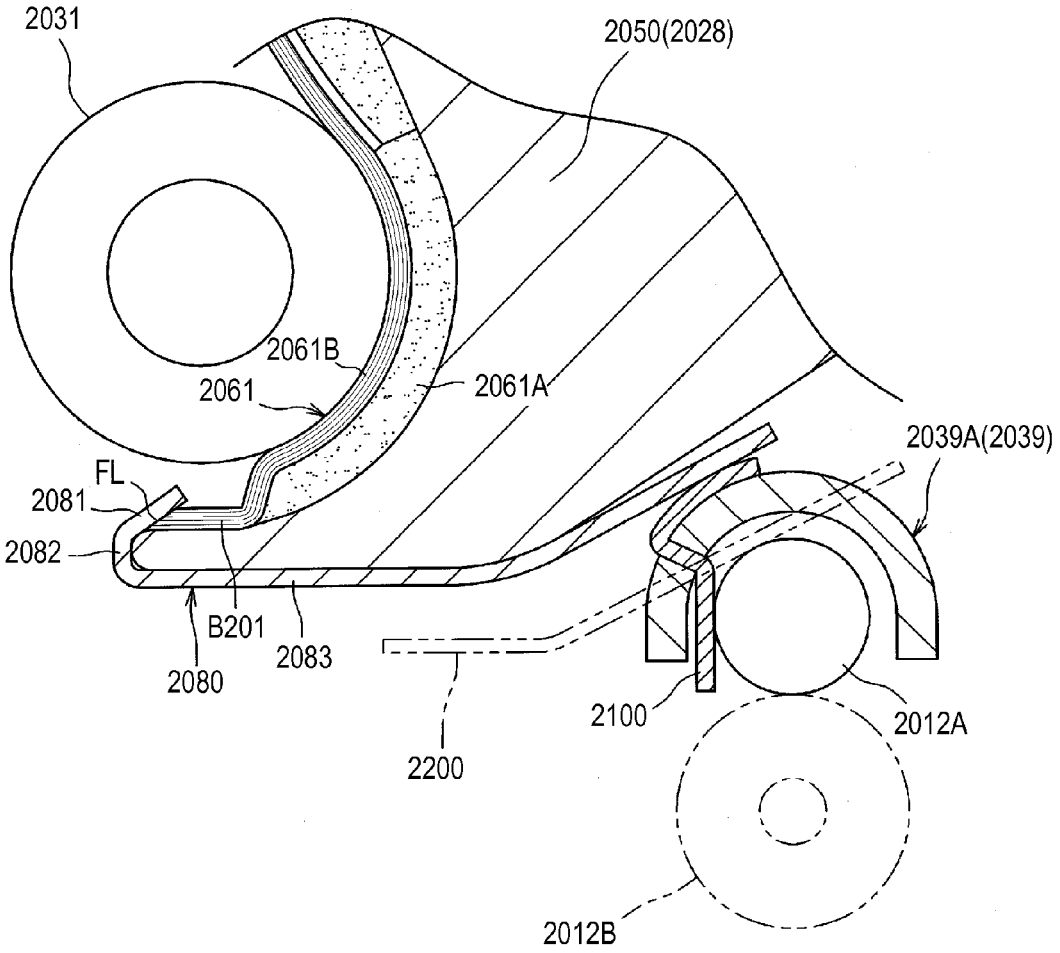
FIG. 20 is a cross-sectional view showing a structure for transferring heat from a fabric member to a pinch roller.

As shown in FIGS. 19A and 19B, in the eleventh illustrative embodiment, an end surface FU on the upper side of the fabric member 2061B (the end surface on the upper side of the longitudinal fiber B201) is formed as a surface orthogonal to the extension direction D1 and an end surface FL on the lower side (the end surface F4 on the lower side of the longitudinal fiber B201) is formed as an inclined surface inclined with respect to the extension direction D1. Further, in the eleventh illustrative embodiment, the fabric member 2061B is formed so as to extend further to the back side than the base material 2061A, the inclined end surface FL on the lower side of the fabric member 2061B is disposed in the vicinity of a rear end of the casing 2050, and a third heat transfer plate 2080 made of metal (an example of a heat transfer member) is brought into contact with the end surface FL. The third heat transfer plate 2080 has an inclined wall portion 2081 which comes into contact with the inclined end surface FL of the fabric member 2061B, a longitudinal wall portion 2082 extending downward along the rear end of the casing 2050 from a lower end of the inclined wall portion 2081, and a lateral wall portion 2083 which extends forward along the lower surface of the casing 2050 from a lower end of the longitudinal wall portion 2082 and comes into contact with a fourth heat transfer plate 2100 (an example of a heat transfer member) shown in FIG. 20.

The fourth heat transfer plate 2100 is a plate-shaped member made of metal and is provided in a drum casing 2039A so as to pass through from the inside of the drum casing 2039A of the drum unit 39 to the outside, and a portion disposed on the outside thereof is in contact with the pinch roller 2012A made of metal (an example of a heat radiation member) provided in the drum casing 2039A. Accordingly, when the sheet 3 is transported between the pinch roller 2012A and the main body-side transport roller 2012B, since heat transmitted from the end surface FL of the fabric member 2061B to the pinch roller 2012A through the third heat transfer plate 2080 and the fourth heat transfer plate 2100 can be taken away by the sheet 3, it is possible to favorably perform heat radiation.

Further, the pinch roller 2012A is supported on the drum casing 2039A so as to be movable in the vertical direction. Then, the main body-side transport roller 2012B described above and a leaf spring 2200 (an example of an elastic member) which biases the pinch roller 2012A toward the main body-side transport roller 2012B are provided in the main body casing 2. Accordingly, heat transmitted to the pinch roller 2012A can be radiated to the main body casing 2 (for example, a sheet metal configuring a side wall of the main body casing 2) through the leaf spring 2200.

The present invention is not limited to the illustrative embodiments described above and can be used in various forms, as illustrated below.

In the tenth and eleventh illustrative embodiments described above, the heat radiation member (the grid electrode 2029B or the like) is indirectly connected to the end surface of the fiber through the heat transfer member (the first heat transfer plate 2070 or the like). However, the present invention is not limited thereto, and the heat radiation member may be directly connected to (brought into contact with) the end surface of the fiber. In addition, the end surface of the fiber with which the heat transfer member or the heat radiation member is brought into contact does not need to be an inclined surface as in the illustrative embodiment described above and may be, for example, a surface orthogonal to the extension direction of the fiber. Further, the heat transfer member or the heat radiation member may be brought into contact with the end surface of the lateral fiber without being limited to the end surface of the longitudinal fiber B201.

In the tenth and eleventh illustrative embodiments described above, the heat transfer members are provided in both the developing cartridge and the drum unit. However, the present invention is not limited thereto and the heat transfer member may be provided in any one of the developing cartridge and the drum unit.

In each illustrative embodiment described above, the developing cartridge 28 integrally having the toner accommodation chamber 34 is illustrated as the developing cartridge. However, the present invention is not limited thereto and the developing cartridge may be, for example, a developing unit on which a toner cartridge having a toner accommodation chamber is removably mounted.

In the tenth and eleventh illustrative embodiments described above, the laser printer is illustrated as an image forming apparatus. However, the present invention is not limited thereto and other image forming apparatuses such as a color printer or a multifunction machine, for example, may be also employed.

In the tenth and eleventh illustrative embodiments described above, the side seal member 2061 has a two-layer structure. However, the present invention is not limited thereto and a three or more layered structure may be also employed as long as it has a fabric member. Further, the seal member is not limited to the side seal member 2061 as long as it is a seal member which comes into sliding contact with a developing roller, and for example, in a case where a seal member is provided in place of the lower film 2063, the present invention may be applied to the seal member.

In the tenth and eleventh illustrative embodiments described above, all of the respective members configuring the heat radiation member are formed of metal. However, the present invention is not limited thereto and the members may be formed of, for example, thermally-conductive resin. Further, the heat radiation member may be a member which cannot be elastically deformed.

In the eleventh illustrative embodiments described above, as the elastic member, the leaf spring 2200 is illustrated. However, the present invention is not limited thereto, and the elastic member may be, for example, a coil spring, a wire spring, or the like.

In the tenth and eleventh illustrative embodiments described above, as an example of the recording sheet, the sheet 3 such as cardboard, postcard, or thin paper is adopted.

However, the present invention is not limited thereto, and for example, an OHP sheet may be also employed.

Twelfth Illustrative Embodiment

Next, a twelfth illustrative embodiment of the present invention will be described in detail. The overall configuration of the laser printer is approximately the same configuration as that in the first illustrative embodiment, and thus configurations in this illustrative embodiment are denoted by the same reference numerals as those in the first illustrative embodiment and description thereof is omitted.

<Detailed Structure of Developing Cartridge>

The detailed structure of the developing cartridge 3028 according to the twelfth illustrative embodiment of the present invention will be described. Since the developing cartridge 3028 has a bilaterally symmetric structure, in FIG. 22 and the like, only a portion on one side of the left and the right is shown and illustration of a portion on the other side is omitted. Further, FIG. 22 shows a state where the developing roller 3031 and the supply roller 3033 are removed.

Figure 22:
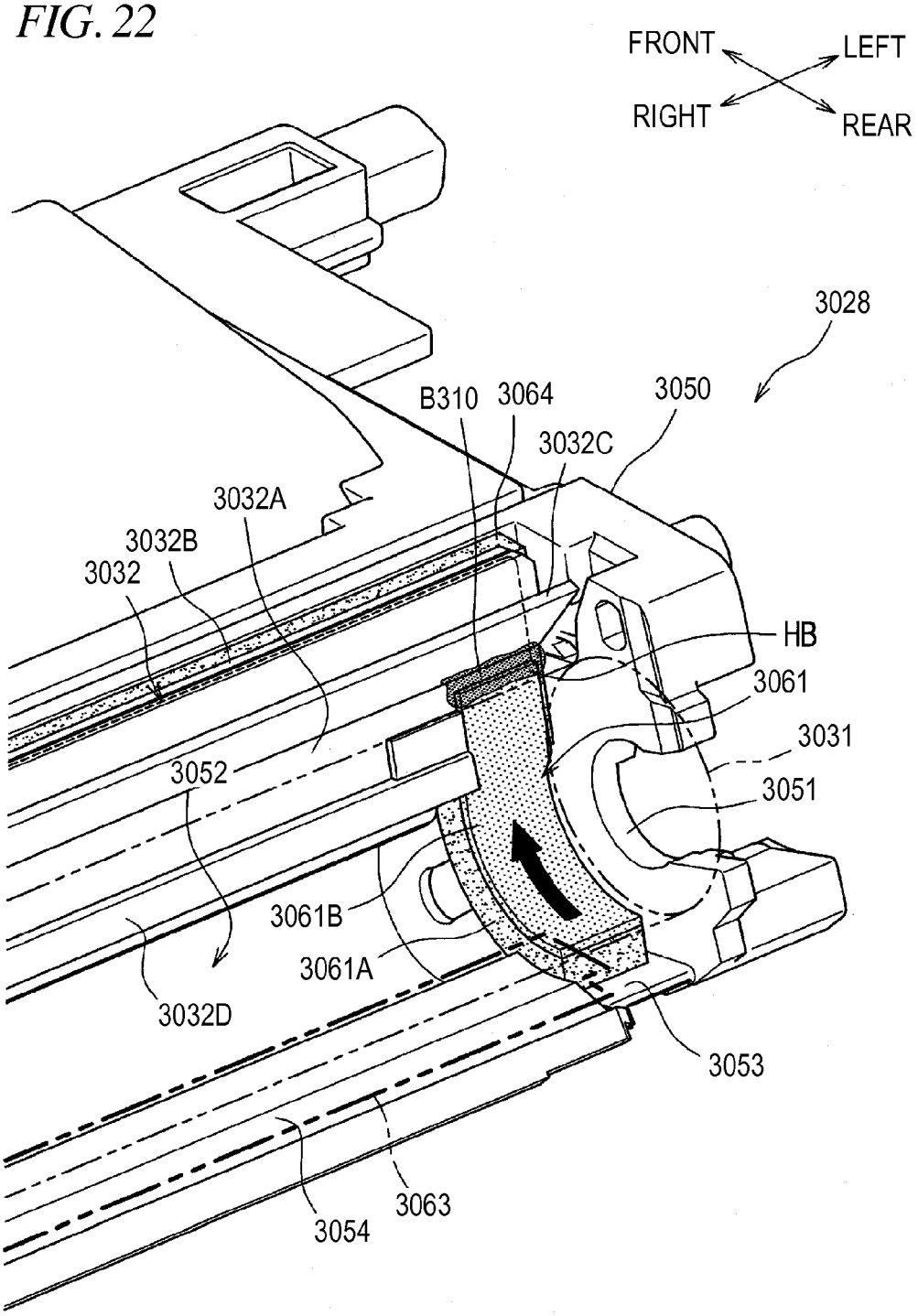
FIG. 22 is a perspective view showing a structure around an opening of a casing.

As shown in FIG. 22, the developing cartridge 3028 includes a casing 3050 for accommodating toner, a side seal member 3061 (an example of a seal member) which comes into sliding contact with each of both end portions of the developing roller 3031, a lower film 3063, and the like, in addition to the developing roller 3031 described above. The developing roller 3031 rotates in a direction of an arrow shown in the drawing, that is, rotates so as to come into sliding contact with the lower film 3063 and the side seal member 3061 in this order.

The casing 3050 includes a bearing section 3051 which rotatably supports the developing roller 3031, an opening 3052 for supplying toner from a toner accommodation chamber 3034 on the inside to the developing roller 3031, a side seal sticking surface 3053 to which the side seal member 3061 is stuck, and a supporting section 3054 which supports the lower film 3063. The opening 3052 is formed into the form of a rectangular long hole along the axial direction of the developing roller 3031, and the layer thickness regulating blade 3032 is fixed to an upper portion thereof.

The layer thickness regulating blade 3032 has the plate-shaped metal plate 3032A which is long in the left-right direction, and the pressing member 3032D which is made of rubber and fixed to the lower end portion (the tip end portion) of the metal plate 3032A. The pressing member 3032D is formed such that the left-right width thereof is smaller than that of the metal plate 3032A. Side seal members 3061 (described later) (specifically, fabric members 3061B) are disposed at left and right end portions of the metal plate 3032A, specifically, outside in the left-right direction the pressing member 3032D.

Figure 21:
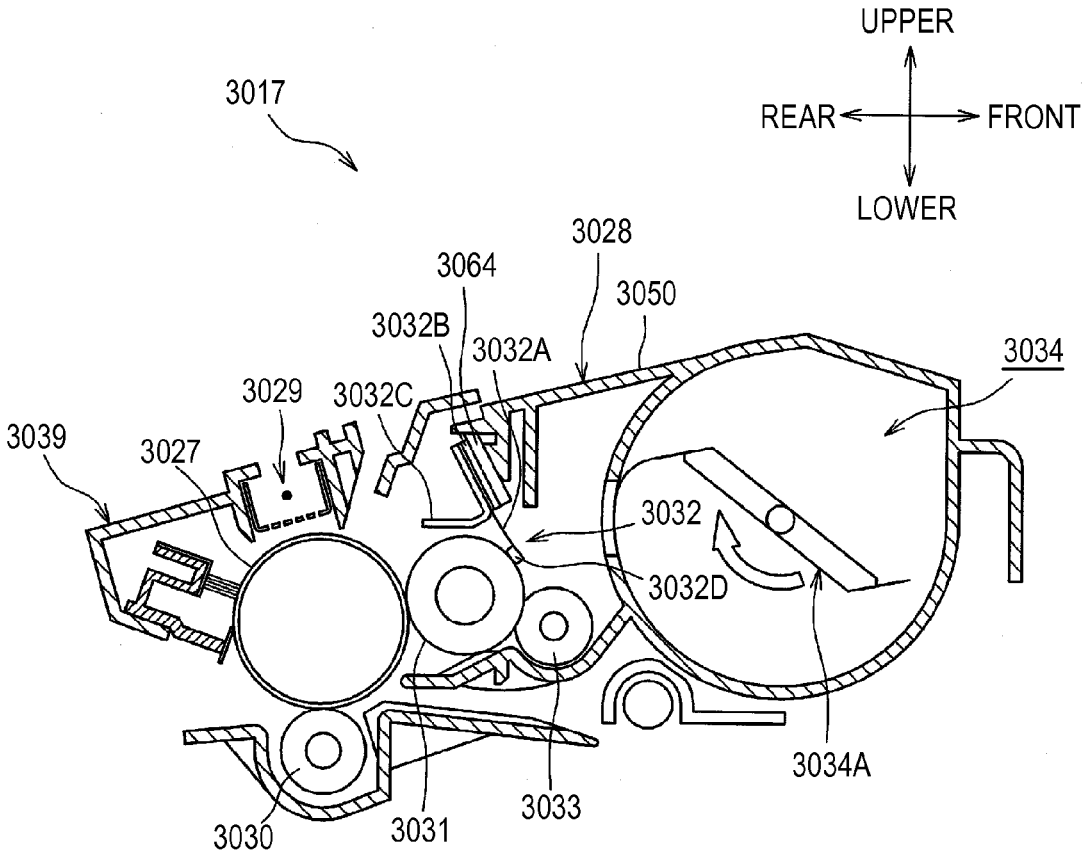
FIG. 21 is a cross-sectional view showing a developing cartridge according to a twelfth illustrative embodiment.

As shown in FIG. 21, at the upper end portion (the end portion on the opposite side to the end portion which comes into contact with the developing roller 3031) of the layer thickness regulating blade 3032, a pair of reinforcing plates 3032B and 3032C made of metal, which sandwiches and reinforces the upper end portion, are provided. Then, the layer thickness regulating blade 3032 and the pair of reinforcing plates 3032B and 3032C are fixed to the casing 3050 through a known blade back seal 3064. In other words, the outer reinforcing plate 3032C (an example of a holding member) sandwiches and holds the layer thickness regulating blade 3032, the inner reinforcing plate 3032B, and the blade back seal 3064 between itself and the casing 3050.

In this illustrative embodiment, the heat radiation member for radiating heat of the side seal member 3061 is configured by the layer thickness regulating blade 3032 described above and the outer reinforcing plate 3032C. The heat radiation member is disposed so as to be exposed to the outside of the casing 3050.

Accordingly, compared to, for example, a configuration in which a heat radiation member is disposed in a casing, since it is possible to cool the heat radiation member by air outside the casing 3050 (for example, air passing through between the casing 3050 and a casing of the drum unit 39), it becomes possible to allow heat which is generated from a sliding contact portion with the developing roller 3031 in the side seal member 3061 to efficiently escape.

As shown in FIG. 22, the side seal sticking surface 3053 is a surface having a substantially arcuate shape in a cross-sectional view and the side seal sticking surfaces 3053 are formed on both left and right sides of the opening 3052. The side seal member 3061 is provided on the side seal sticking surface 3053. The side seal member 3061 will be described in detail later.

The supporting section 3054 is formed so as to protrude further to the developing roller 3031 side than the side seal sticking surface 3053 and extend along the axial direction of the developing roller 3031. The lower film 3063 is provided on the upper surface of the supporting section 3054.

The lower film 3063 is a sheet-like member made of resin such as polyethylene terephthalate and extends along the axial direction of the developing roller 3031 to come into sliding contact with approximately the entirety of the developing roller 3031. Then, the lower film 3063 is formed longer in the left-right direction than the supporting section 3054 and disposed such that in a state where the lower film 3063 is stuck to the supporting section 3054, both end portions thereof protrude from the supporting section 3054, thereby overlapping the side seal members 3061. Accordingly, it becomes possible to favorably suppress toner leakage between the side seal member 3061 and the lower film 3063.

Figure 23:
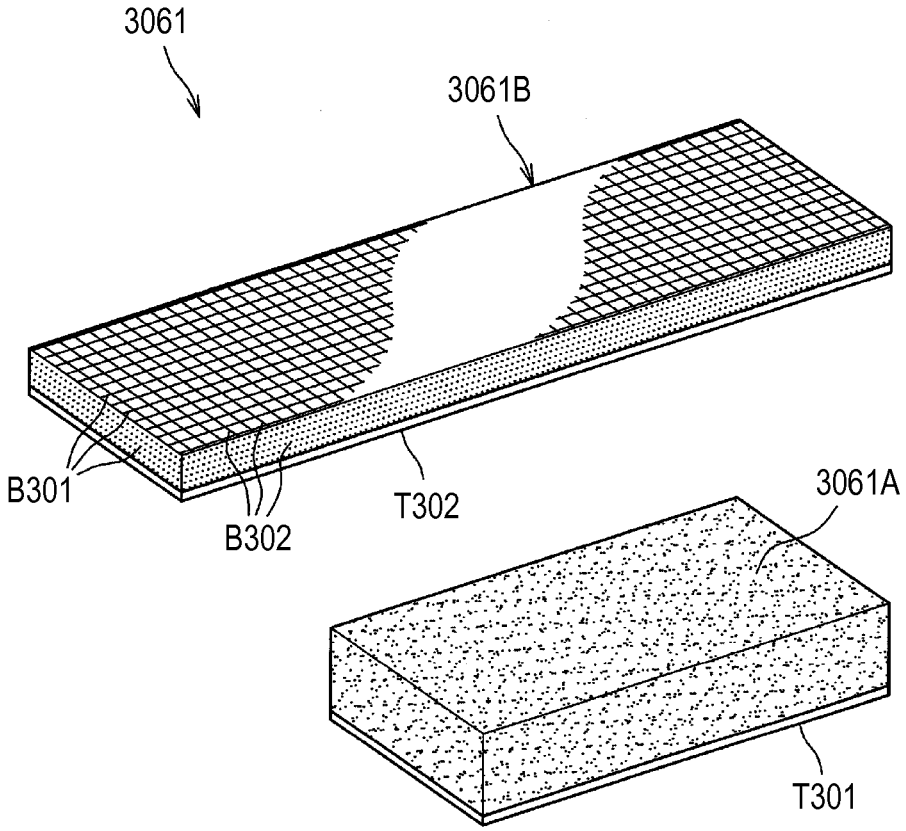
FIG. 23 is an exploded perspective view showing a side seal member in a simplified manner.
Figure 24:
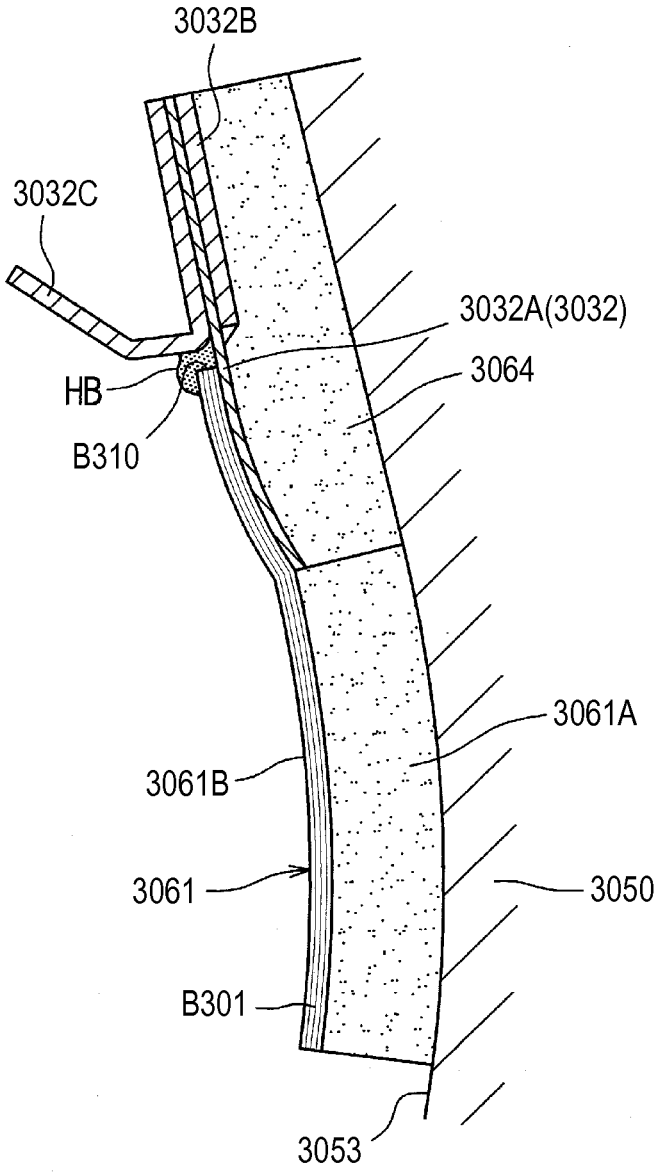
FIG. 24 is a cross-sectional view showing a state where the side seal member is mounted on a casing.

The side seal member 3061 is a member for suppressing toner leakage from the gap between each of both end portions of the developing roller 3031 which is disposed so as to face the opening 3052 of the casing 3050 and the side seal sticking surface 3053, and is provided between each of both end portions of the developing roller 3031 and the side seal sticking surface 3053. As shown in FIGS. 23 and 24, the side seal member 3061 includes the base material 3061A having elasticity and the fabric member 3061B which is laminated on the surface on the developing roller 3031 side of the base material 3061A.

The base material 61A is formed of an elastic body such as an elastically-deformable urethane sponge and is stuck to the side seal sticking surface 3053 of the casing 3050 by the double-sided tape T301 so as to be adjacent to the lower end of the blade back seal 3064. In addition, in FIG. 24, for convenience, illustration of the double-sided tapes T301 and T302 is omitted.

The fabric member 3061B is formed into a long sheet shape extending along the rotation direction of the developing roller 3031 and is configured by interweaving a plurality of longitudinal fibers B301 extending in the longitudinal direction and a plurality of lateral fibers B302 extending in the short side direction so as to intersect each other. Further, with respect to the diameter of each of the fibers B301 and B302 of the fabric member 3061B, the diameter of the longitudinal fiber B301 is about 150 μm and the diameter of the lateral fiber B302 is about 200 μm.

Further, with respect to the weave, twill weave or satin weave may be preferable. Here, the longitudinal direction (the rotation direction of the developing roller 3031) is an example of a first direction and the short side direction (the axial direction of the developing roller 3031) is an example of a second direction.

Specifically, the longitudinal fiber B301 is provided in a plurality in the short side direction of the fabric member 3061B and also provided in a plurality in the thickness direction of the fabric member 3061B. Further, the lateral fiber B302 is provided in a plurality in the longitudinal direction of the fabric member 3061B and also provided in a plurality in the thickness direction of the fabric member 3061B. In, for example, FIG. 22 and the like, each of the fibers B301 and B302 is appropriately omitted in consideration of the visibility of the drawing.

Each of the fibers B301 and B302 has a circumferential surface in which a heat radiation amount per unit area is the first heat radiation amount, and an end surface in which a heat radiation amount per unit area is the second heat radiation amount larger than the first heat radiation amount. Specifically, as each of the fibers B301 and B302 having such properties, it is possible to adopt a fiber having a molecular structure in which molecules are arranged linearly, and it is possible to adopt, for example, an ultrahigh molecular weight polyethylene or PBO (polyparaphenylenebenzobisoxazole) fiber or the like. Specifically, a fiber may be preferable in which thermal conductivity (at 100K) in a direction toward the end surface equal to or greater than 0.1 W/cm·K and equal to or less than 1.0 W/cm·K and is equal to or greater than two to 50 times of the thermal conductivity in a circumferential surface direction. In this illustrative embodiment, the Dyneema (registered trademark) SK60 fiber manufactured by Toyobo Co., Ltd. is used.

The fabric member 3061B is formed so as to be longer than the base material 3061A in the longitudinal direction and is stuck to the base material 3061A and the metal plate 3032A of the layer thickness regulating blade 3032 by the double-sided tape T302. The end surface B310 on the upper side of the fabric member 3061B is adhered to the metal plate 3032A and the outer reinforcing plate 3032C by a thermally-conductive adhesive HB.

Since the end surface B310 of the fabric member 3061B (the end surface of each longitudinal fiber B301) is connected to the metal plate 32A and the reinforcing plate 32C through the thermally-conductive adhesive HB, compared to, for example, a structure in which the end surface of a fabric member is not adhered to a metal plate or a reinforcing plate by a thermally-conductive adhesive, it is becomes possible to efficiently propagate heat generated at the sliding contact portion between the developing roller 3031 and fabric member 3061B along the extension direction (a direction in which molecules are arranged) of each longitudinal fiber B301 and then allow the heat to escape to the metal plate 3032A and the like through the thermally-conductive adhesive HB.

Further, since the end surface B103 of the fabric member 3061B (the end surface of the longitudinal fiber B301) and the metal plate 3032A and the like are bonded to each other by the thermally-conductive adhesive HB, compared to, for example, a structure in which the end surface of a longitudinal fiber and a heat radiation member are merely brought into contact with each other, it is possible to reliably connect the end surface of the longitudinal fiber B301 and the metal plate 3032A, and thus it becomes possible to reliably perform heat transfer from the end surface of the longitudinal fiber B301 to the metal plate 3032A and the like. In addition, since the end surface B310 of the fabric member 3061B is connected to both the metal plate 3032A and the reinforcing plate 3032C by the thermally-conductive adhesive HB, compared to, for example, a structure in which the end surface of a fabric member is connected to only the metal plate 3032A by a thermally-conductive adhesive, it becomes possible to efficiently radiate heat of the fabric member 3061B.

Here, as the thermally-conductive adhesive HB, for example, various adhesives as shown in examples (described later), a thermally-conductive adhesive transfer tape (manufactured by Sumitomo 3M Co., Ltd.), or the like can be used. However, in a case of using a thermally-conductive adhesive in which the highest temperature between the application and the curing is lower than a melting temperature of a fiber, since it is possible to prevent a fiber from being melted due to heat which is generated from the thermally-conductive adhesive between the application of the thermally-conductive adhesive and the curing of the thermally-conductive adhesive and maintain the thermal conductivity of a fiber, it may be preferable to use a thermally-conductive adhesive made of such a material. In addition, as such a thermally-conductive adhesive, for example, four adhesives as shown in the examples (described later) can be given.

Next, action of radiating heat generated from the sliding contact portion between the developing roller 3031 and the side seal member 3061 will be described in detail.

As shown in FIG. 22, if the developing roller 3031 rotates, both end portions of the developing roller 3031 and the surfaces on the developing roller 3031 side of the fabric members 3061B come into sliding contact with each other. Then, in a case where heat is generated from the sliding contact portion between the developing roller 3031 and the fabric member 3061B, the heat is transmitted along each longitudinal fiber B301 and then efficiently transmitted from the end surface on the upper side of each longitudinal fiber B301 to the metal plate 3032A or the reinforcing plate 3032C through the thermally-conductive adhesive HB, thereby being radiated to the outside of the casing 3050 through the reinforcing plate 3032C. Therefore, according to this illustrative embodiment, it is possible to favorably radiate the heat generated from the sliding contact portion between the developing roller 3031 and the side seal member 3061 to the outside.

In addition, since the heat radiation member is not in contact with the end surface on the lower side of the longitudinal fiber B301 and specifically, the end surface is in contact with air, a heat radiation amount from the end surface is smaller. Further, since the heat radiation member is also not in contact with the end surface of each lateral fiber B302 (the end surface is in contact with air), a heat radiation amount from the end surface is smaller and the heat of each lateral fiber B302 is transmitted to each longitudinal fiber B301 having a relatively low temperature.

Further, in this illustrative embodiment, since the existing layer thickness regulating blade 3032 and the outer reinforcing plate 3032C are used as the heat radiation members, compared to, for example, a configuration in which a heat radiation member other than a layer thickness regulating blade or a reinforcing plate is newly provided, it is possible to suppress an increase in the number of components.

Thirteenth Illustrative Embodiment

Next, a thirteenth illustrative embodiment of the present invention will be described in detail. Since this illustrative embodiment has a structure in which a portion of the structure according to the twelfth illustrative embodiment described above is changed, approximately the same constituent elements as those in the twelfth illustrative embodiment are denoted by the same reference numerals as those in the twelfth illustrative embodiment and description thereof is omitted.

Figure 25A:
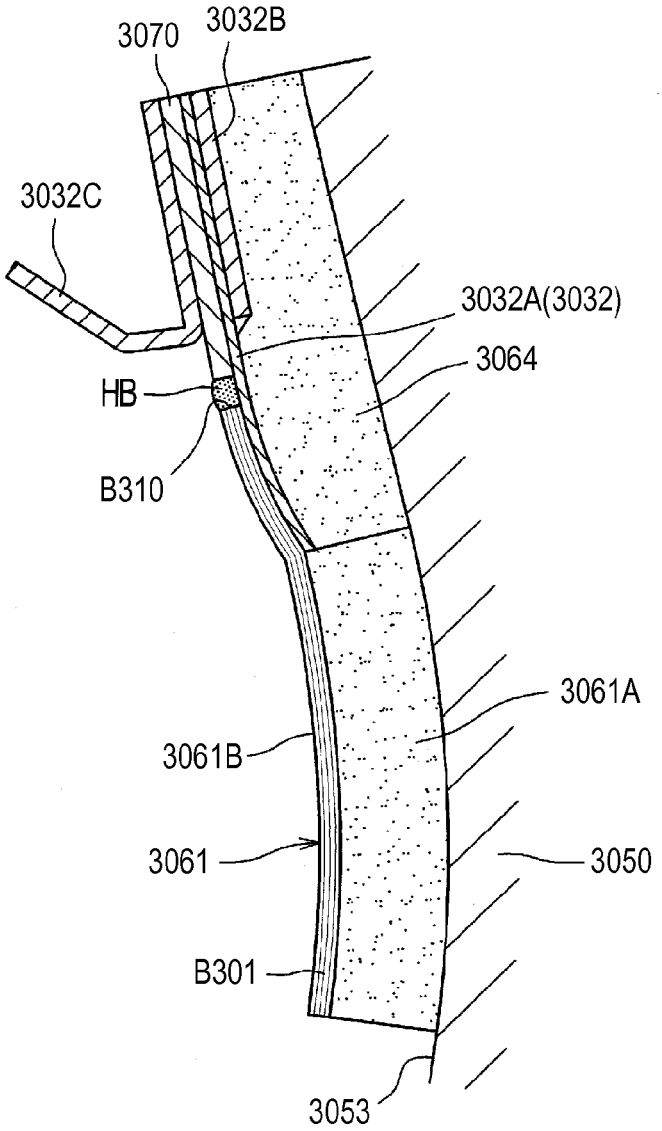
FIG. 25A is a cross-sectional view showing a structure around a side seal member in a thirteenth illustrative embodiment.
Figure 25B:
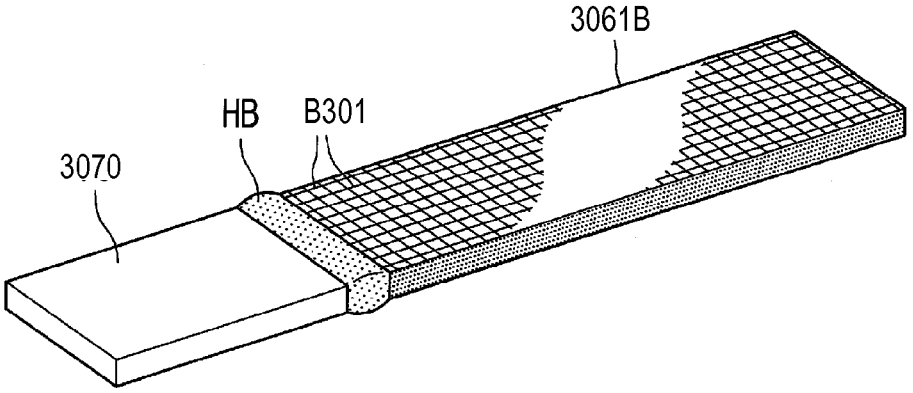
FIG. 25B is a perspective view showing a state where a spacer member and a fabric member are bonded to each other by a thermally-conductive adhesive.

As shown in FIGS. 25A and 25B, in the thirteenth illustrative embodiment, a spacer member 3070 (an example of a heat radiation member) is provided between the reinforcing plate 3032C and the metal plate 3032A. The spacer member 3070 is a plate-shaped member made of metal and is sandwiched and held between the reinforcing plate 3032C and the metal plate 3032A. Then, the end surface B310 of the fabric member 3061B is bonded to the spacer member 3070 by the thermally-conductive adhesive HB. Specifically, before the work of assembling the layer thickness regulating blade 3032 or the reinforcing plate 3032C to the casing 3050, the spacer member 3070 and the fabric member 3061B are adhered to each other by the thermally-conductive adhesive HB in advance, as shown in FIG. 25B. Accordingly, since the fabric member 3061B and the spacer member 3070 can be handled as a single component, the work of applying the thermally-conductive adhesive HB is not required at the time of assembly work, and thus it is possible to easily perform the assembly work.

The present invention is not limited to each illustrative embodiment described above and can be used in various forms, as illustrated below.

In the twelfth and thirteenth illustrative embodiments described above, the developing cartridge 3028 integrally having the toner accommodation chamber 3034 is illustrated as the developing device. However, the present invention is not limited thereto, and the developing device may be, for example, a developing unit on which a toner cartridge having a toner accommodation chamber is removably mounted.

In the twelfth and thirteenth illustrative embodiments described above, the laser printer is illustrated as an image forming apparatus on which the developing device is mounted. However, the present invention is not limited thereto, and other image forming apparatuses such as a color printer or a multifunction machine, for example, may be also employed.

In the twelfth and thirteenth illustrative embodiments described above, the side seal member 3061 has a two-layer structure. However, the present invention is not limited thereto and a three or more layered structure may be also employed as long as it has a fabric member. Further, the seal member is not limited to the side seal member 3061 as long as it is a seal member which comes into sliding contact with a developing roller, and for example, in a case where a seal member is provided in place of the lower film 3063, the present invention may be applied to the seal member.

In the twelfth and thirteenth illustrative embodiments described above, all of the respective members configuring the heat radiation member are formed of metal.

However, the present invention is not limited thereto, and the members may be formed of, for example, thermally-conductive resin.

EXAMPLES

Hereinafter, examples of the illustrative embodiment described above will be described. Specifically, results of experiments examining a heat radiation effect by a thermally-conductive adhesive are shown.

Various conditions of the experiments in the examples are as follows.

(1) Fabric Member

A fabric woven using the Dyneema (registered trademark) fibers manufactured by Toyobo Co., Ltd. and cut to a size having a width of 7 mm and a length of 40 mm was disposed in the layout as in the twelfth illustrative embodiment. In this case, the distance between the end surface on the upper side of a fabric member and a reinforcing plate was set to be 0.5 mm.

(2) Developing Roller

A developing roller was rotated at a linear speed of 52.3 cm/sec for a predetermined time (60 min.).

(3) Thermally-Conductive Adhesive

Four types of thermally-conductive adhesives as shown in the table of FIG. 26 were applied to a gap between the end surface on the upper side of the fabric member and the reinforcing plate.

(4) Temperature Measurement Method

The temperature of an end portion of the developing roller was measured using a non-contact thermometer (MODEL 530 04 manufactured by Yokogawa Electric Corporation).

The temperature of the end portion of the developing roller was examined by performing an experiment under the conditions as described above. In addition, as a comparative example, an experiment under the condition that a thermally-conductive adhesive was not applied was also performed.

Figure 27:
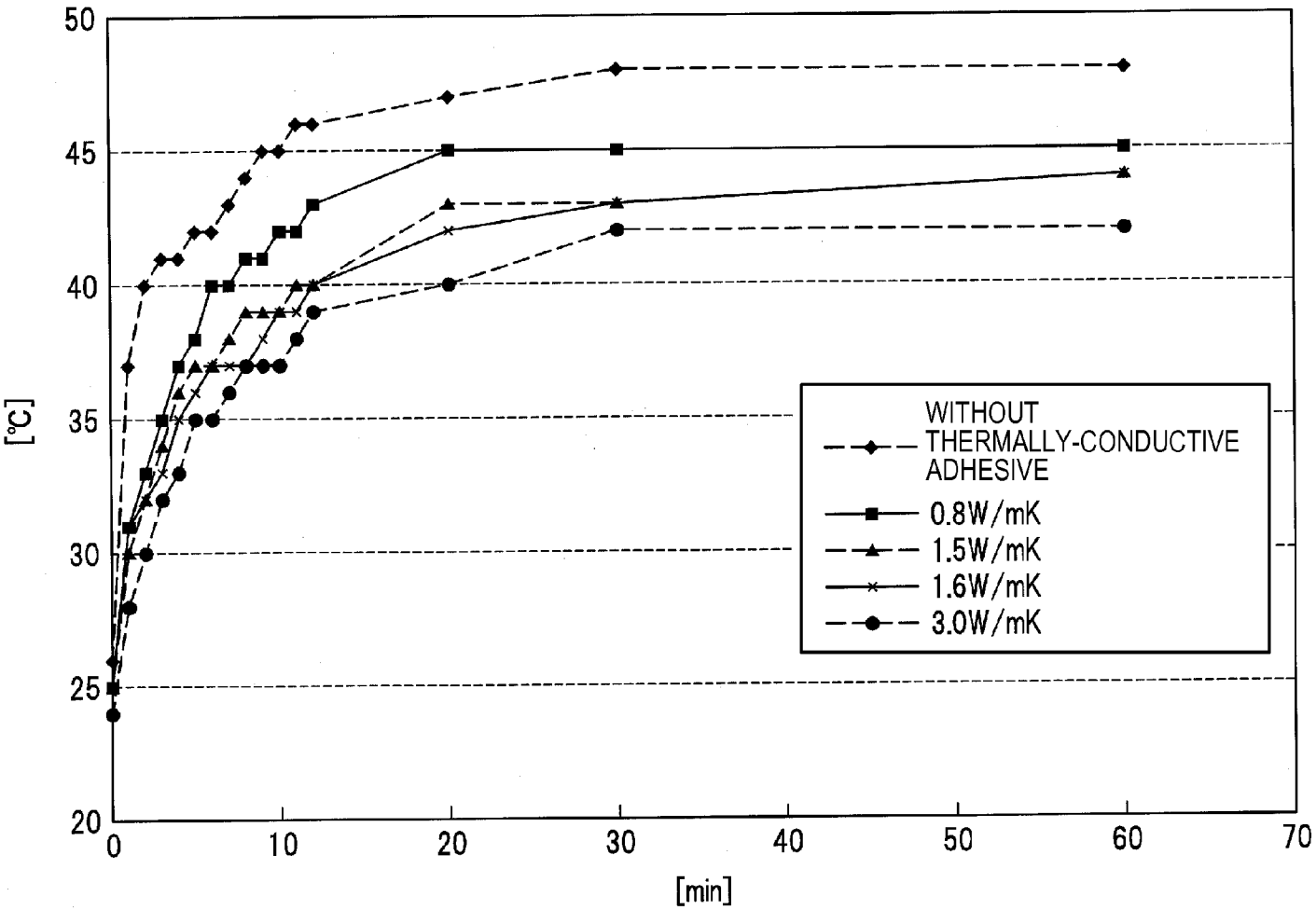
FIG. 27 is a graph showing experimental results of the examples.

FIG. 27 shows the experimental results of the respective experiments. FIG. 27 is a graph in which the horizontal axis shows the time and the vertical axis shows the temperature of the end portion of the developing roller. In FIG. 27, the rhombus mark is the experimental result of the comparative example in which a thermally-conductive adhesive was not applied, the square mark is an experimental result when a thermally-conductive adhesive 1 (MODEL SCH-20 manufactured by Sunhayato Corp.) having a thermal conductivity of 0.8 W/mK shown in FIG. 26 was applied, and the triangle mark is an experimental result when a thermally-conductive adhesive 2 (CW2400 manufactured by ITW Chemtronics) having a thermal conductivity of 1.5 W/mK shown in FIG. 26 was applied. Further, the x mark is an experimental result when a thermally-conductive adhesive 3 (1225B manufactured by ThreeBond Co., Ltd.) having a thermal conductivity of 1.6 W/mK shown in FIG. 26 was applied, and the ○ mark is an experimental result when a thermally-conductive adhesive 4 (2955 manufactured by ThreeBond Co., Ltd.) having a thermal conductivity of 3.0 W/mK shown in FIG. 26 was applied.

From the experimental results, it was confirmed that in any of the cases of four types of thermally-conductive adhesives, compared to the comparative example in which a thermally-conductive adhesive was not applied, it was possible to reduce the temperature of the end portion of the developing roller. Further, it was confirmed that the larger the thermal conductivity of a thermally-conductive adhesive, the more the temperature of the end portion of the developing roller can be reduced.

What is claimed is:

1. A developing device comprising:

a casing configured to accommodate developer;

a developing roller;

a seal member, at least a portion of which is disposed between the developing roller and the casing, the seal member including a fabric member including a plurality of first fibers extending in a first direction that is perpendicular to an axial direction of the developing roller and parallel to a longitudinal direction of the seal member, the fabric member having a first surface facing the developing roller, and a second surface opposite to the first surface, the fabric member having cutouts at both sides of the first surface and the second surface while leaving a portion of the fabric member uncut; and a heat radiation member configured to contact end surfaces of the plurality of first fibers of the seal member and radiate heat of the seal member, the heat radiation member including protrusions engaging the cutouts such that the protrusions are in contact with the end surfaces of the plurality of first fibers, wherein each of the plurality of first fibers of the fabric member includes a circumferential surface that has a first heat radiation amount per unit area, and the end surfaces having a second heat radiation amount per unit area larger than the first heat radiation amount, wherein the end surfaces of the plurality of first fibers include a surface that intersects with the first direction, and wherein the developing roller contacts the circumferential surface of the first fibers.

2. The developing device according to claim 1, wherein the fabric member of the seal member includes a plurality of second fibers extending in a second direction different from the first direction, and wherein the plurality of first fibers and the plurality of second fibers intersect each other.

3. The developing device according to claim 1, wherein the heat radiation member is disposed at a position other than a portion facing the developing roller of the fabric member.

4. The developing device according to claim 1, wherein the protrusions are configured to cut the plurality of first fibers.

5. The developing device according to claim 1, wherein the heat radiation member is formed of metal.

6. The developing device according to claim 1, wherein the heat radiation member is fixed to the fabric member.

7. A process cartridge comprising:

a developing cartridge including:

a casing configured to accommodate developer;

a developing roller;

a seal member, at least portion of which is disposed between the developing roller and the casing, the seal member including a fabric member including a plurality of first fibers extending in a first direction that is perpendicular to an axial direction of the developing roller and parallel to a longitudinal direction of the seal member, the fabric member having a first surface facing the developing roller, and a second surface opposite to the first surface, the fabric member having cutouts at both sides of the first surface and the second surface while leaving a portion of the fabric member uncut; and a heat radiation member configured to contact end surfaces of the plurality of fibers of the seal member and radiate heat of the seal member, the heat radiation member including protrusions engaging the cutouts such that the protrusions are in contact with the end surfaces of the plurality of fibers; and a drum unit including a photosensitive drum disposed to face the developing roller, and on which the developing cartridge is configured to be removably mounted, wherein each of the plurality of fibers of the fabric member includes a circumferential surface that has a first heat radiation amount per unit area, and the end surfaces having a second heat radiation amount per unit area larger than the first heat radiation amount, wherein the end surfaces of the plurality of fibers include a surface that intersects with the first direction, and wherein the developing roller contacts the circumferential surface of the fibers.

8. The process cartridge according to claim 7, wherein at least one of the developing cartridge and the drum unit includes a heat transfer member configured to transfer heat from the end surfaces of the plurality of fibers of the seal member to the heat radiation member.

9. The process cartridge according to claim 8, wherein the drum unit includes a charger configured to electrically charge the photosensitive drum, wherein the charger includes a charging wire configured to generate corona discharge, and a grid electrode disposed between the charging wire and the photosensitive drum.

10. The process cartridge according to claim 8, wherein the drum unit includes a transport roller configured to transport a recording sheet.

11. The process cartridge according to claim 10, wherein the transport roller is movably provided in the drum unit.

12. An image forming apparatus comprising:

an apparatus main body; and the process cartridge according to claim 11, configured to be removably mounted on the apparatus main body, wherein the apparatus main body includes:

a main body-side transport roller disposed to face the transport roller; and an elastic member configured to bias the transport roller toward the main body-side transport roller.

* * * * *